US009121235B2

(12) United States Patent
Orgeron

(10) Patent No.: US 9,121,235 B2
(45) Date of Patent: Sep. 1, 2015

(54) TUBULAR STAND BUILDING AND RACKING SYSTEM

(71) Applicant: T&T Engineering Services, Inc., Tomball, TX (US)

(72) Inventor: Keith J. Orgeron, Spring, TX (US)

(73) Assignee: T&T Engineering Services, Inc., Tomball, TX (US)

( * ) Notice: Subject to any disclaimer, the term of this patent is extended or adjusted under 35 U.S.C. 154(b) by 155 days.

(21) Appl. No.: 13/687,974

(22) Filed: Nov. 28, 2012

(65) Prior Publication Data

US 2013/0330151 A1 Dec. 12, 2013

Related U.S. Application Data

(60) Provisional application No. 61/564,280, filed on Nov. 28, 2011.

(51) Int. Cl.

| | |
|---|---|
| ***E21B 19/14*** | (2006.01) |
| ***E21B 19/087*** | (2006.01) |
| ***E21B 19/15*** | (2006.01) |
| ***E21B 19/20*** | (2006.01) |

(52) U.S. Cl.

CPC ..... *E21B 19/14* (2013.01); *E21B 19/087* (2013.01); *E21B 19/155* (2013.01); *E21B 19/20* (2013.01)

(58) Field of Classification Search

USPC ..... 175/52, 85; 414/22.51–22.59, 414/22.61–22.69, 22.71

See application file for complete search history.

(56) References Cited

U.S. PATENT DOCUMENTS

| | | | | |
|---|---|---|---|---|
| 3,294,185 | A * | 12/1966 | O'Neill et al. | 175/85 |
| 3,633,771 | A * | 1/1972 | Woolslayer et al. | 414/22.55 |
| 3,682,259 | A * | 8/1972 | Cintract et al. | 175/85 |
| 3,978,993 | A * | 9/1976 | Howard | 414/22.55 |
| 4,765,401 | A | 8/1988 | Boyadjieff | |
| 4,821,816 | A | 4/1989 | Willis | |
| 5,901,613 | A * | 5/1999 | Forslund | 74/490.03 |
| 6,220,807 | B1 * | 4/2001 | Sorokan | 414/22.62 |
| 6,343,892 | B1 * | 2/2002 | Kristiansen | 405/195.1 |
| 6,398,457 | B2 * | 6/2002 | Baugh | 405/170 |
| 6,550,128 | B1 * | 4/2003 | Lorenz | 29/464 |
| 6,923,613 | B2 * | 8/2005 | Stuyt | 414/719 |
| 7,228,919 | B2 * | 6/2007 | Fehres et al. | 175/85 |

(Continued)

FOREIGN PATENT DOCUMENTS

| | | | | |
|---|---|---|---|---|
| WO | WO 2004018829 A1 * | 3/2004 | | E21B 19/15 |
| WO | WO 2008103156 A2 * | 8/2008 | | E21B 19/20 |
| WO | WO 2011120627 A2 * | 10/2011 | | |

*Primary Examiner* — Gregory Adams

(74) *Attorney, Agent, or Firm* — John G. Fischer, Esq.; Scheef & Stone, L.L.P.

(57) ABSTRACT

The present invention provides a rapid rig-up and rig-down pipe stand building and racking system that is capable of being retrofit to an existing drilling rig. In particular, the invention relates to a horizontal to vertical pipe delivery machine that is mountable to a drilling rig. The horizontal to vertical machine delivers sections of pipe to a pair of drilling rig mounted elevators. The elevators receive and vertically translate the sections of pipe. A power tong may be used to make connections between the sections of pipe to form a pipe stand, and may also break the connections of the pipe stand. A drill floor mounted pipe racking system receives the connected drill pipe from the elevators. A pipe racking system that may be used in conjunction with the stand building system is capable of controlled, rapid, and precise movement of multiple connected sections of pipe.

2 Claims, 30 Drawing Sheets

(56) References Cited

U.S. PATENT DOCUMENTS

| | | | | |
|---|---|---|---|---|
| 7,246,983 | B2 | 7/2007 | Zahn et al. | |
| 7,331,746 | B2 | 2/2008 | Wright et al. | |
| 7,452,177 | B2 * | 11/2008 | Gokita | 414/694 |
| 7,677,856 | B2 * | 3/2010 | Standal | 414/22.63 |
| 7,744,327 | B2 * | 6/2010 | Lops et al. | 414/22.52 |
| 7,967,541 | B2 * | 6/2011 | Stroshein et al. | 414/22.65 |
| 2002/0074125 | A1 * | 6/2002 | Fikes et al. | 166/352 |
| 2003/0155154 | A1 * | 8/2003 | Oser | 175/52 |
| 2004/0211598 | A1 | 10/2004 | Palidis | |
| 2005/0193645 | A1 | 9/2005 | Barnes | |
| 2006/0151215 | A1 * | 7/2006 | Skogerbo | 175/52 |
| 2007/0017704 | A1 * | 1/2007 | Belik | 175/52 |
| 2008/0304939 | A1 * | 12/2008 | Dekker et al. | 414/22.63 |
| 2009/0185883 | A1 * | 7/2009 | Wright et al. | 414/22.54 |
| 2009/0257848 | A1 | 10/2009 | Stroshein et al. | |
| 2010/0034620 | A1 * | 2/2010 | Orgeron | 414/22.55 |
| 2011/0079434 | A1 | 4/2011 | Belik et al. | |

* cited by examiner

TUBULAR STAND BUILDING AND RACKING SYSTEM

TECHNICAL FIELD OF INVENTION

The present invention relates to a new apparatus and method for use in subterranean exploration. The present invention provides a rapid rig-up and rig-down pipe stand building system that is capable of being retrofit to an existing drilling rig. In particular, the invention relates to a drilling rig mountable horizontal to vertical pipe delivery machine. The pipe delivery machine delivers pipe to a pair of drilling rig mounted elevators. A drill floor mounted pipe racking system receives the drill pipe from the elevators. The pipe racking system is capable of controlled, rapid, and precise movement of multiple connected sections of pipe. The elevator system is mounted in between for make-up of the single pipe joints into a pipe stand.

BACKGROUND OF THE INVENTION

In the exploration of oil, gas and geothermal energy, drilling operations are used to create boreholes, or wells, in the earth. Subterranean drilling necessarily involves the movement of long lengths of tubular sections of pipe. At various intervals in the drilling operation, all of the drill pipe must be removed from the wellbore. This most commonly occurs when a drill bit wears out, requiring a new drill bit to be located at the end of the drill string. It can also be necessary to reconfigure the bottom-hole assembly or replace other downhole equipment that has otherwise failed. When the drill pipe has to be removed, it is disconnected at every second or third connection, depending on the height of the mast. On smaller drilling rigs used in shallower drilling, every other connection is disconnected, and two lengths of drill pipe, known as "doubles," are lifted off of the drill string, aligned in the fingers of the rack by the derrickman, and then lowered onto the drill floor away from the well center. On larger drilling rigs used for deeper drilling, every third connection is disconnected and three lengths of drill pipe, known as "triples," are lifted off of the drill string, aligned in the fingers of the rack by the derrickman, and then lowered onto the drill floor away from the well center. The doubles and triples are called a stand of pipe. The stands are stored vertically on the rig floor, aligned neatly between the fingers of the rack on the mast.

Removing all of the drill pipe from the well and then reconnecting it to run back into the well is known as "tripping the pipe" or "making a trip," since the drill bit is making a round trip from the bottom of the hole to the surface and then back to the bottom of the hole. Tripping the drill pipe is a very expensive and dangerous operation for a drilling rig. Most injuries that occur on a drilling rig are related to tripping the pipe. Additionally, the wellbore is making no progress while the pipe is being tripped, so it is downtime that is undesirable. This is why quality drill bits are critical to a successful drill bit operation. Drill bits that fail prematurely can add significant cost to a drilling operation. Since tripping pipe is "non-drilling time," it is desirable to complete the trip as quickly as possible. Most crews are expected to move the pipe as quickly as possible. The pipe stands are long and thin (about ninety feet long).

There are a number of variables that contribute to irregular and hostile movement of the pipe stand as it is disconnected and moved to the rack for setting on the drill floor, as well as when it is being picked up for alignment over the wellbore center for stabbing and connection to the drill string in the wellbore. For example, the vertical alignment and travel of the elevator and hoist connection which lift the drill string from the wellbore is cable connected, and capable of lateral movement which is translated to the drill string rising from the wellbore. Also, the drill string is supported from the top, and as the derrickman moves the drill string laterally, the accelerated lateral movement of the long length of the pipe stand away from the well center generates a wave form movement in the pipe itself. As a result of the natural and hostile movement of the heavy drill stand, which typically weighs between 1,500 and 2,000 pounds, and drill collars which weigh up to 20,000 pounds, it is necessary for the crew members to stabilize the drill pipe manually by physically wrestling the pipe into position. The activity also requires experienced and coordinated movement between the driller operating the drawworks and the derrickman and floorhands. Needless to say, many things can and do go wrong in this process, which is why tripping pipe and pipe racking is a primary safety issue in a drilling operation.

Attempts have been made to mechanize all or part of the pipe racking operation. On offshore platforms, where funding is justifiable and where drill floor space is available, large Cartesian racking systems have been employed, in which the pipe stands are gripped at upper and lower positions to add stabilization, and tracked modules at the top and bottom of the pipe stand coordinate the movement of the pipe stand from the wellbore center to a racked position. Such systems are very large and very expensive, and are not suitable for use on a traditional land-based drilling rig.

A previous attempt to mechanize pipe racking on conventional land-based drilling rigs is known as the Iron Derrickman® pipe-handling system. The apparatus is attached high in the mast, at the rack board, and relies on a system of hydraulics to lift and move stands of drill pipe and collars from the hole center to programmed coordinates in the racking board. This cantilever mast mounted system has a relatively low vertical load limit, and therefore requires assistance of the top drive when handling larger diameter collars and heavy weight collars.

The movement of the pipe with this system is somewhat unpredictable and requires significant experience to control. It grasps the pipe from above the center of gravity of the tubular and fails to control the hostile movement of the pipe stand sufficiently to allow for safe handling of the stands or for timely movement without the intervention of drilling crew members. In particular, the system is not capable of aligning the lower free end of the drill stand accurately for stabbing into the drill string in the wellbore. As a result of these and other deficiencies, the system has had limited acceptance in the drilling industry.

An alternative system that is known provides vertical lifting capacity from the top drive and a lateral movement only guidance system located near the rack. The system still requires a floorman for stabbing the pipe to the stump as well as to the set-back position.

A primary difficulty in mechanizing pipe stand racking is the hostile movement of the pipe that is generated by stored energy in the stand, misaligned vertical movement, and the lateral acceleration and resultant bending and oscillation of the pipe, which combine to generate hostile and often unpredictable movements of the pipe, making it hard to position, and extremely difficult to stab.

A conflicting difficulty in mechanizing pipe stand racking is the need to move the pipe with sufficient rapidity so that cost savings are obtained over the cost of manual manipulation by an experienced drilling crew. The greater accelerations required for rapid movement store greater amounts of energy in the pipe stand, and greater attenuated movement of the stand.

Another primary obstacle in mechanizing pipe stand racking is the prediction and controlled management of the pipe stand movement sufficient to permit the precise alignment required for stabbing the pipe to a first target location on the drill floor and to a second target location within the fingers of the racking board.

An even greater obstacle in mechanizing pipe stand racking is the prediction and controlled management of the pipe stand movement sufficient to achieve the precise alignment required for stabbing the tool joint of the tubular held by the racking mechanism into the receiving tubular tool joint connection extending above the wellbore and drill floor.

Another obstacle to land-based mechanizing pipe stand racking is the lack of drilling floor space to accommodate a railed system like those that can be used on large offshore drilling rigs.

Another obstacle to mechanizing pipe stand racking is the several structural constraints that are presented by the thousands of existing conventional drilling rigs, where the need to retrofit is constrained to available space and structure. For example, existing structures require orthogonal movement of the drill stand over a significant distance and along narrow pathways for movement.

Another obstacle to mechanizing pipe stand racking is the need to provide a reliable mechanized solution that is also affordable for retrofit to a conventional drilling rig. Still another obstacle to mechanizing pipe stand racking is the need to grip and lift pipe stands within the narrow confines of parallel rows of pipe stands in a conventional rack.

It is also desirable to minimize accessory structure and equipment, particularly structure and equipment that may interfere with transportation or with manpower movement and access to the rig floor during drilling operations. It is further desirable to ergonomically limit the manpower interactions with rig components during rig-up for cost, safety and convenience.

Thus, technological and economic barriers have prevented the development of a pipe racking system capable of achieving these goals. Conventional prior art drilling rig configurations remain manpower and equipment intensive to trip pipe and rack pipe when tripping. Alternative designs have failed to meet the economic and reliability requirements necessary to achieve commercial application. In particular, prior art designs fail to control the natural attenuation of the pipe and fail to position the pipe with sufficient rapidity and accuracy.

A goal of the present invention is to achieve rapid and accurate unmanned movement of the pipe between the racked position and the over-well position. Thus, the racker of the present invention must avoid storage of energy within the positioning structure. True verticality is critical to limiting the energy storage of the system. Additionally, controlled movement and positional holding of the stand is critical to allowing rapid movement by adding the stiffness to the system.

In summary, the various embodiments of the present invention provide a unique solution to the problems arising from a series of overlapping design constraints, including limited drill floor space, and obtaining sufficient stiffness from a retrofittable assembly to provide a controlled and precise automated movement and racking of drill pipe. More specifically, the various embodiments of the present invention provide for lateral movement of the pipe stand independent of assistance from the top drive, and without extension and retraction of the top drive for handing the pipe stand to the racking system. This provides free time for the top drive to move with the racker system in positioning the pipe without assistance from the top drive. Additionally, the various embodiments of the present invention provide a device capable of precise and accurate stabbing of the drill stand, resulting in faster trip time.

SUMMARY OF THE INVENTION

The present invention provides a new and novel pipe stand building and racking system and method of use. In one embodiment, a horizontal to vertical machine is provided. The horizontal to vertical machine is mountable to a conventional drilling rig. The horizontal to vertical machine has a gripper for gripping the exterior of a tubular (such as drill pipe). The horizontal to vertical machine is capable of grasping and raising a tubular from a horizontal position near the ground to a vertical position proximate to the edge of the drilling floor.

A lower elevator is mounted to the drilling rig for receiving a tubular in a vertical orientation from the horizontal to vertical machine. The lower elevator may be pivotally connected to the drilling rig so that it may be attached in a horizontal position prior to raising the substructure. The lower elevator has at least one gripper that is vertically translatable along the length of the lower elevator. The gripper is capable of clamping onto the exterior of a drilling tubular and supporting the load of the tubular.

An automatic pipe racker is provided, having a base frame connectable to a drill floor of a drill rig and extending upwards at a position offset to a V-door side of a drilling mast that is also connected to the drill floor. In one embodiment, the base frame is a C-frame design. A mast brace may be connected between the base frame and the drilling mast at a position distal to the drill floor for stabilizing an upper end of the base frame in relationship to the mast. In one embodiment, the mast brace is adjustable for tilting the automatic pipe racker slightly towards the mast. A tensioner may be connected between the base frame and the drilling floor for stabilizing the base frame in relationship to the substructure.

The automatic pipe racker is capable of moving stands of pipe between the racked position and the over-well position.

In one embodiment, a lateral extend mechanism is pivotally connectable to the base frame. The lateral extend mechanism is extendable between a retracted position and a deployed position. A rotate mechanism is connected to the lateral extend mechanism and is rotatable in each of the left and right directions. A finger extend mechanism is connected to the rotate mechanism. The finger extend mechanism is laterally extendable between a retracted position and a deployed position.

A vertical grip and stab mechanism is attached to the finger extend mechanism. The gripping mechanism has grippers to hold a tubular or stand of pipe and is capable of moving the pipe vertically to facilitate stabbing. The lateral extend mechanism is deployable to move the rotating finger extend and gripping mechanisms between a position beneath a racking board cantilevered from the mast and a position substantially beneath the mast.

In another embodiment, movement of the lateral extend mechanism between the retracted position and the deployed position moves the rotate mechanism along a substantially linear path. In a more preferred embodiment, movement of the lateral extend mechanism between the retracted position and the deployed position moves the rotate mechanism along a substantially horizontal path.

The rotate mechanism is rotatable in each of a left and right direction. In a more preferred embodiment, the rotate mechanism is rotatable in each of a left and right direction by at least ninety degrees. In another preferred embodiment, the pipe stand gripping mechanism is vertically translatable to vertically raise and lower the load of a stand of pipe.

In another embodiment, the automatic pipe racking system is series nesting. In this embodiment, the finger extend and grip and stab mechanisms are substantially retractable into the rotate mechanism, which is substantially retractable into the pivot frame of the lateral extend mechanism, which is substantially retractable into the base frame.

An upper elevator is pivotally connected to the base frame for receiving a tubular in a vertical orientation from a lower elevator. The upper elevator has an upper gripper and a lower gripper. The upper gripper is vertically translatable along the length of the upper elevator. The upper and lower grippers are both capable of clamping onto the exterior of a drilling tubular and supporting the load of the tubular.

A stand building power tong is provided for rotating tubular to be connected between the upper elevator and the lower elevator.

In operation, the horizontal to vertical machine grips a first tubular, such as a section of drill pipe, and raises it from a horizontal position near the ground to a vertical position proximate to the drill floor. The lower elevator receives the first tubular from the horizontal to vertical machine. The lower elevator raises the first tubular vertically, where the upper elevator grips and vertically raises the first tubular.

The horizontal to vertical machine grips a second tubular and raises it from a horizontal position near the ground to a vertical position proximate to the drill floor. The lower elevator receives the second tubular from the horizontal to vertical machine. The lower elevator raises the second tubular vertically, until the female connection of the second tubular engages the male connection of the first tubular. The stand building power tong rotates the one of the tubular in relation to the other to make-up the threaded connection between them. The upper elevator then grips and vertically raises the connected first and second tubulars.

The horizontal to vertical machine then grips a third tubular and raises it from a horizontal position near the ground to a vertical position proximate to the drill floor. The lower elevator receives the third tubular from the horizontal to vertical machine. The lower elevator raises the third tubular vertically, until the female connection of the third tubular engages the male connection of the second tubular. The stand building power tong rotates the one of the tubular in relation to the other to make-up the threaded connection between them. The upper elevator then grips and vertically raises the connected first, second and third tubulars (referred to as the pipe "stand") to a position below the racking board.

The automatic pipe racker receives the connected pipe stand from the upper elevator, wherein the upper elevator releases the connected pipe stand. In one embodiment, the upper elevator may then be rotated with respect to the base frame of the automatic pipe racker such that the upper elevator is no longer in the way.

In another embodiment, the automatic pipe racker then tilts the connected pipe stand inside the racking board. The automatic pipe racker may be tilted by actuating linearly adjustable mast braces connected to the drilling mast. The automatic pipe racker is then used to locate the pipe stand in the racking boards, and to move the pipe stand between the racking board and the well.

As will be understood by one of ordinary skill in the art, the sequence of the steps disclosed may be modified and the same advantageous result obtained. For example, the wings may be deployed before connecting the lower mast section to the drill floor (or drill floor framework).

BRIEF DESCRIPTION OF THE DRAWINGS

The objects and features of the invention will become more readily understood from the following detailed description and appended claims when read in conjunction with the accompanying drawings in which like numerals represent like elements.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein.

Figure 1:
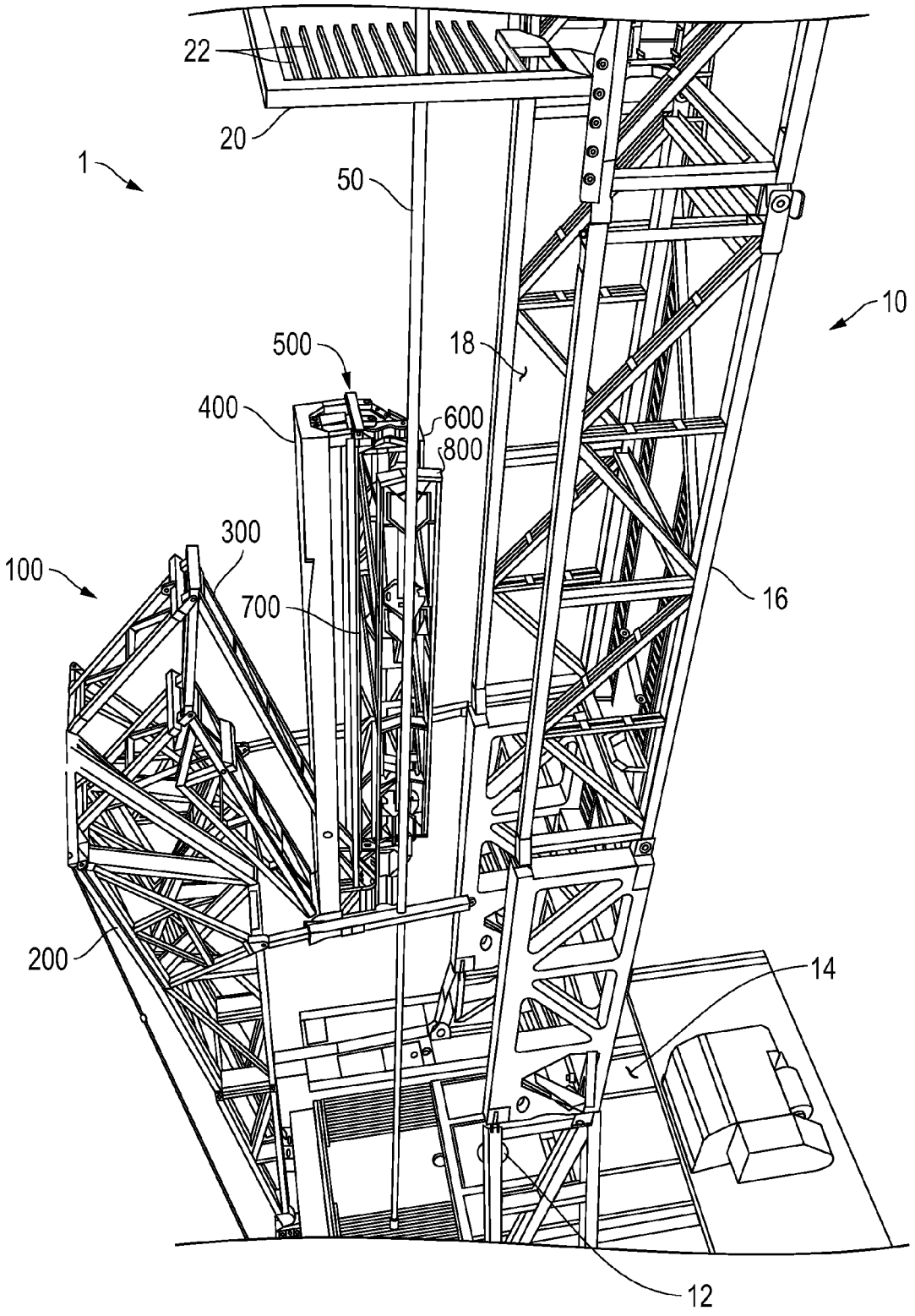
FIG. 1 is an isometric view of a drilling rig fitted with an automatic pipe racking system having features in accordance with embodiments of the present invention.

FIG. 1 is an isometric view of a racking mechanism 100 including features of the automatic stand building system 1. As it pertains to the present invention, racking mechanism 100 is one component of automatic stand building system 1. Although significant detail is provided below for racking mechanism 100, it will be appreciated that many variations and modifications may be considered desirable by those skilled in the art based upon a review of the following description of one preferred embodiment.

As seen in FIG. 1, a drilling rig 10 is located over a wellbore 12. Drilling rig 10 has a drill floor 14 and a drilling mast 16 extending upwards above drill floor 14 and located over wellbore 12. Drilling mast 16 has an open V-door side 18. A racking board 20 extends horizontally outward on V-door side 18. Racking board 20 has a plurality of fingers 22 extending horizontally for supporting drill pipe 50 when it is removed from wellbore 12. Racking mechanism 100 is mounted to drill floor 14, on V-door side 18 of drilling mast 16.

Figure 2:
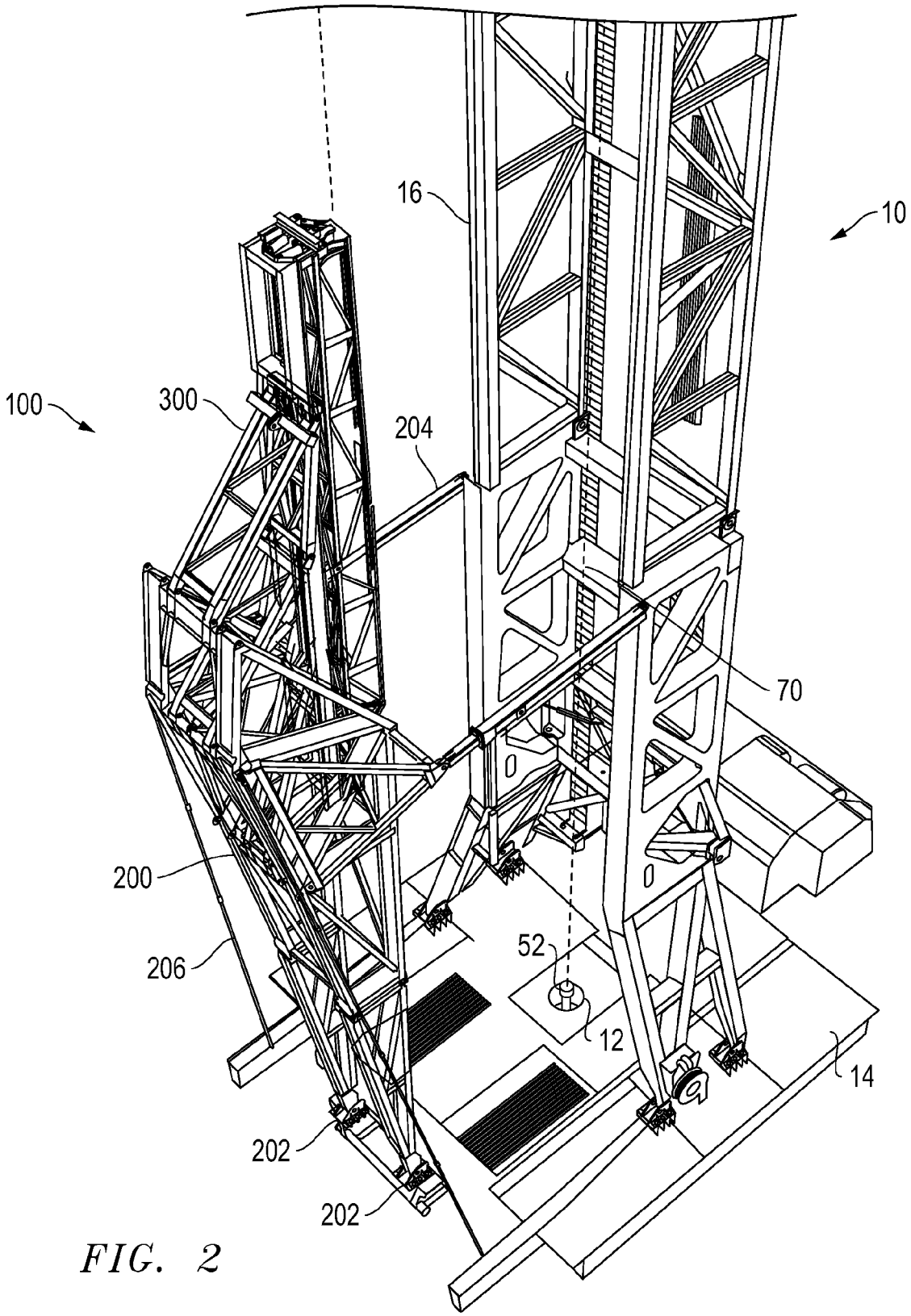
FIG. 2 is an isometric view of the racking mechanism illustrating the mechanism fully retracted within the base frame.

FIG. 2 is an isometric view of racking mechanism 100 in accordance with one embodiment of the invention, illustrating racking mechanism 100 in the fully retracted position. Racking mechanism 100 is comprised of a base frame 200 that is connected to drill floor 14 by floor pins 202. In one embodiment, base frame 200 is a tapered C-frame that extends upwards from drill floor 14 at a position offset to V-door side 18 of drilling mast 16. A mast brace 204 is connected between base frame 200 and drilling mast 16 at a position distal to drill floor 14 for stabilizing an upper end of base frame 200 in relationship to drilling mast 16. In one embodiment, a pair of tensioning members 206 is connected between drill floor 14 and base frame 200. Tensioning members 206 provide further support and stability to the base frame 200 with respect to the drill floor 14.

In one embodiment, base frame 200 comprises a pair of deployable wings 208 (not shown), pivotally attached to base frame 200. When wings 208 are deployed outward, deployed ends of wings 208 are connected to base frame 200 by struts 210 (not shown). In this embodiment, mast braces 204 are connected to the deployed ends of wings 208, increasing the spacing between mast braces 204 to facilitate conflict free operation of racking mechanism 100. Retraction of wings 208 provides a narrower transport profile for transporting racking mechanism 100 between drilling sites.

As seen in FIG. 2, wellbore 12 has a vertical well centerline 70 that extends through and above the entrance of wellbore 12. Well centerline 70 represents the theoretical target location for stabbing drill pipe 50. Mast brace 204 stabilizes an upper end of base frame 200 in relationship to drilling mast 16. In a preferred embodiment, the length of mast brace 204 is adjustable to compensate for deflection of racking mechanism 100 under different payloads which vary with the size of the tubular being handled. Adjustment is also advantageous to accommodate non-verticality and settling of drilling rig 10. Adjustment is also useful for connectivity to other mechanisms that deliver or receive pipe from racking mechanism 100.

Figure 3:
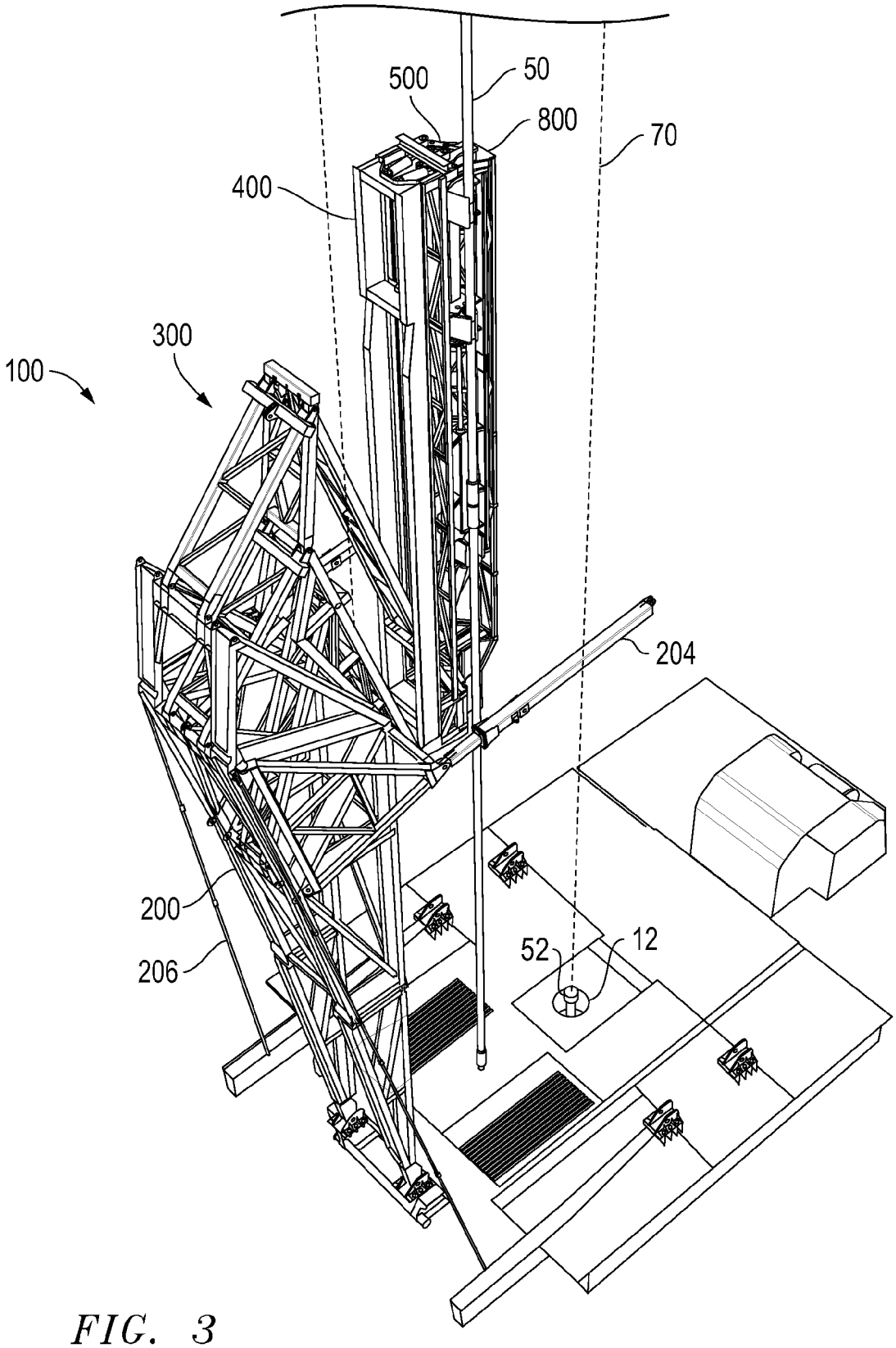
FIG. 3 is an isometric view of the racking mechanism illustrating the lateral extend mechanism partially deployed.
Figure 4:
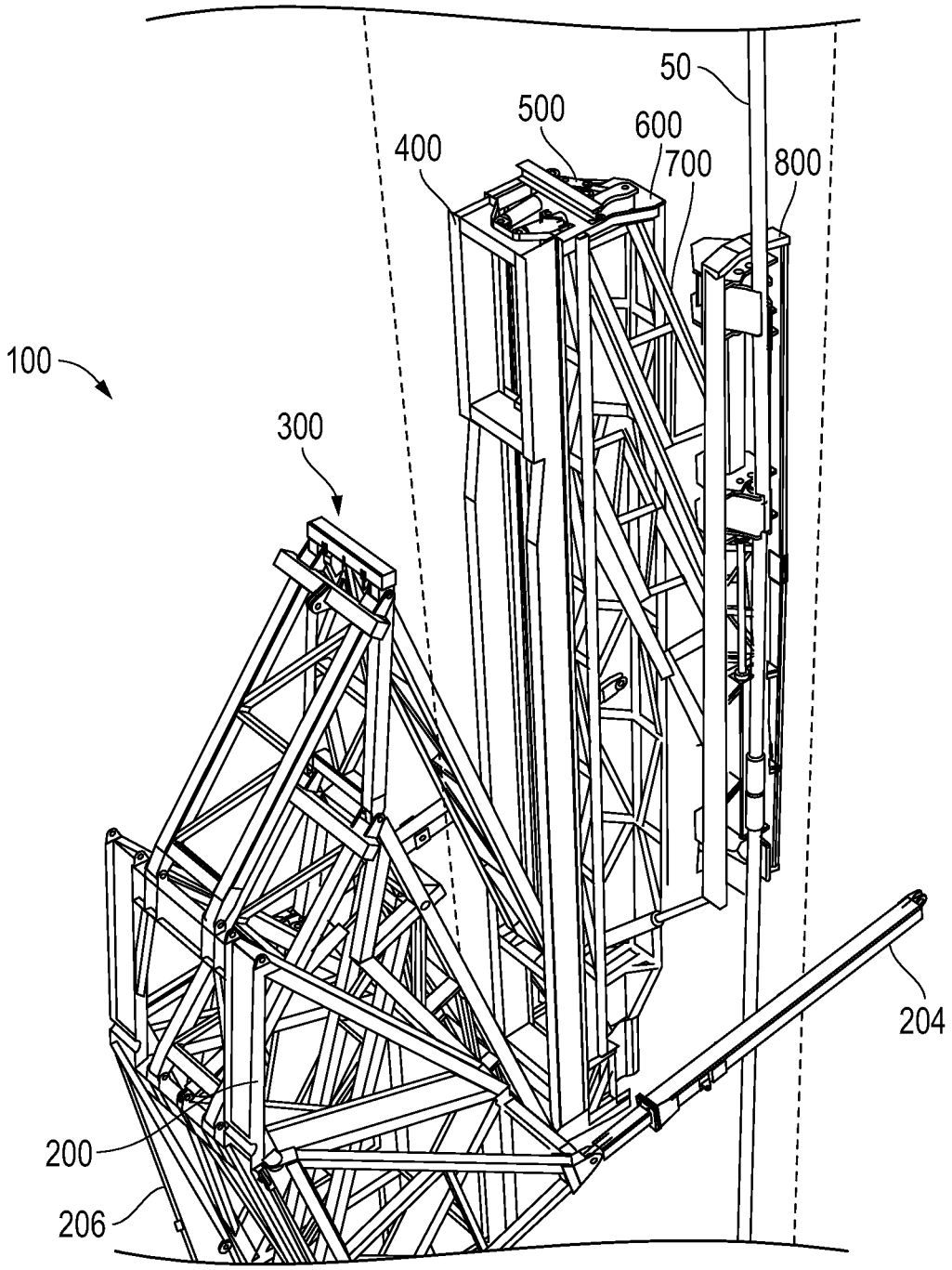
FIG. 4 is an isometric view of the racking mechanism illustrating the lateral extend mechanism partially deployed, and further illustrating the rotate mechanism rotated 90 (ninety) degrees, and the finger extend mechanism partially deployed, such as in position to receive or to set back a stand of drill pipe in a racking board.

FIG. 3 is an isometric view of racking mechanism 100, illustrating racking mechanism 100 partially deployed. In FIG. 3 and FIG. 4, drilling mast 16 of drilling rig 10 has been removed for clarity.

A lateral extend mechanism 300 is pivotally connected to base frame 200. Lateral extend mechanism 300 is extendable between a retracted position, substantially within base frame 200, and a deployed position which extends in the direction of well centerline 70. In FIG. 3, as compared to FIG. 2, lateral extend mechanism 300 is partially deployed.

Lateral extend mechanism 300 includes a pivot frame 400. A rotate mechanism 500 is connected to pivot frame 400. A finger extend mechanism 700 (not visible) is connected to rotate mechanism 500. A grip and stab mechanism 800 is connected to rotate mechanism 500. FIG. 3 illustrates rotate mechanism 500 rotated 90 (ninety) degrees, with finger extend mechanism 700 in the retracted position. This position is intermediate of positions for receiving or setting back a stand of drill pipe in racking board 20.

In a preferred embodiment (best seen in FIG. 1), lateral extend mechanism 300 is particularly configured such that upon deployment towards well centerline 70, rotate mechanism 500, finger extend mechanism 700, and grip and stab mechanism 800 are movable to a position beneath racking board 20, and further to a position substantially within drilling mast 16. Also in a preferred embodiment, lateral extend mechanism 300 is particularly configured to be force-balanced, such that upon partial extension, lateral extend mechanism 300 is not inclined to retract or extend, as contrasted to a parallelogram linkage. The benefit of this configuration is that a low pushing force is required to actuate lateral extend mechanism 300 into deployment or retraction.

In another embodiment, racking mechanism 100 is further balanced such that upon failure of the power supply and/or hydraulic pressure, lateral extend mechanism 300 will be slightly more inclined to retract under gravitational force than to extend.

FIG. 4 is an isometric view of racking mechanism 100, illustrating lateral extend mechanism 300 partially deployed, and further illustrating rotate mechanism 500 rotated 90 (ninety) degrees and finger extend mechanism 700 partially deployed. As best seen in FIG. 2, finger extend mechanism 700 (not shown) may be retracted into the interior space of rotate mechanism 500 (not shown) to permit passage through the narrow alley formed between stands of pipe 50 stacked on drill floor 14 when tripping drill pipe 50 out of wellbore 12, such as when changing the drill bit. As contrasted, the position illustrated in FIG. 4 is exemplary of a position for receiving or setting back a stand of drill pipe in racking board 20.

Figure 5:
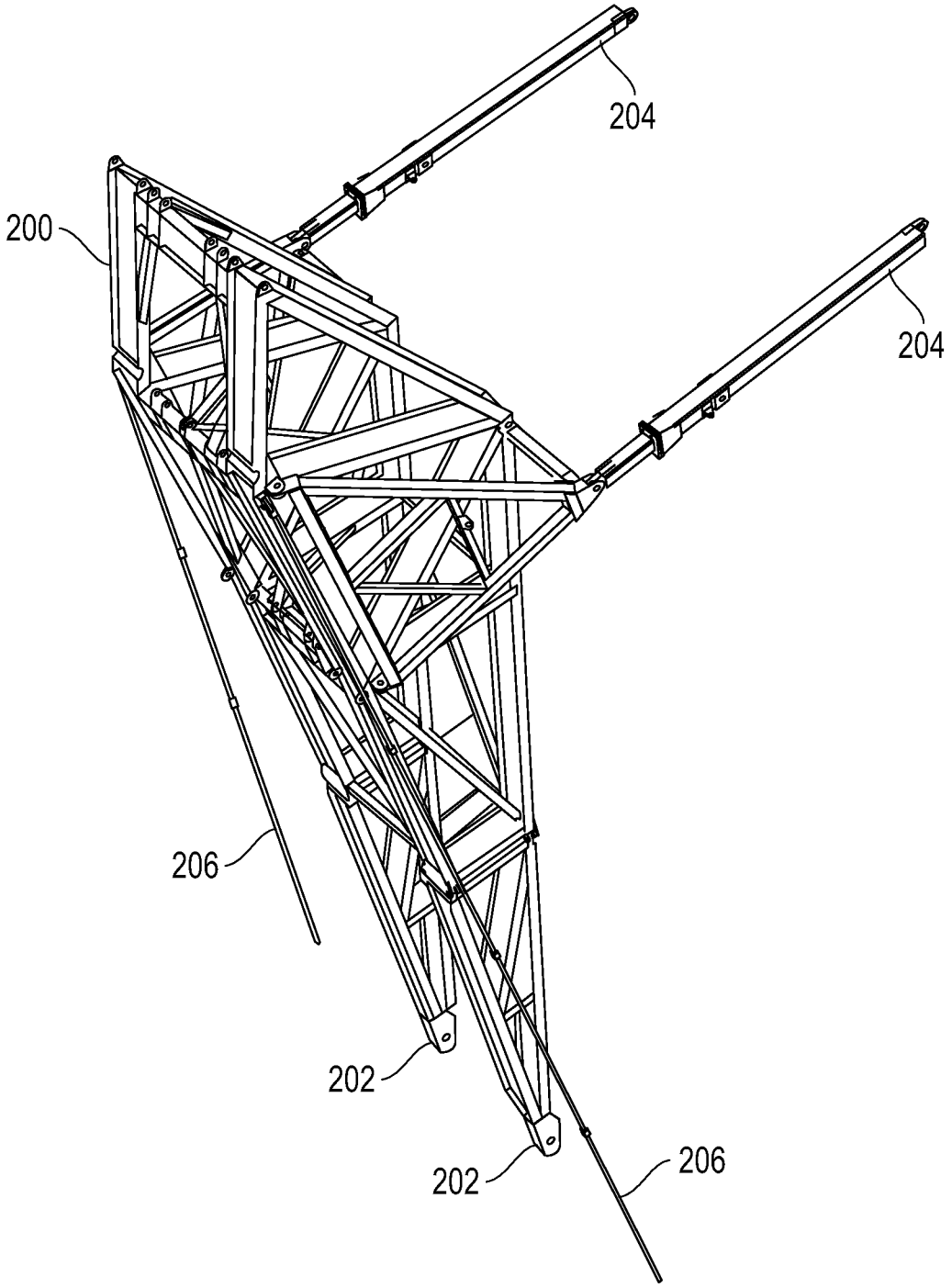
FIG. 5 is an isometric view of the base frame of the racking mechanism illustrating the base frame in isolation of the remaining components of the racking mechanism and of the drilling rig.

FIG. 5 is an isometric view of base frame 200 of racking mechanism 100, illustrating base frame 200 in isolation of the remaining components of racking mechanism 100 and of drilling rig 10. Base frame 200 is pivotally connected to drill floor 14 (not shown) by floor pins 202. A mast brace 204 connects each side of base frame 200 to drilling mast 16 (not shown) of drilling rig 10 (not shown). Mast braces 204 stabilize base frame 200 of racking mechanism 100. In a preferred embodiment, mast braces 204 are adjustable to compensate for verticality of drilling mast 16 and for the variable deflection of racking mechanism 100 when handling different sizes of drill pipe 50.

In another preferred embodiment, a tensioning member 206 connects each side of base frame 200 to drill floor 14 (not shown) of drilling rig 10 (not shown). Tensioning members 206 stabilize base frame 200 of racking mechanism 100. In a preferred embodiment, tensioning members 206 are adjustable to compensate for verticality of racking mechanism 100, and for the variable deflection of racking mechanism 100 when handling different sizes of drill pipe 50.

Figure 6:
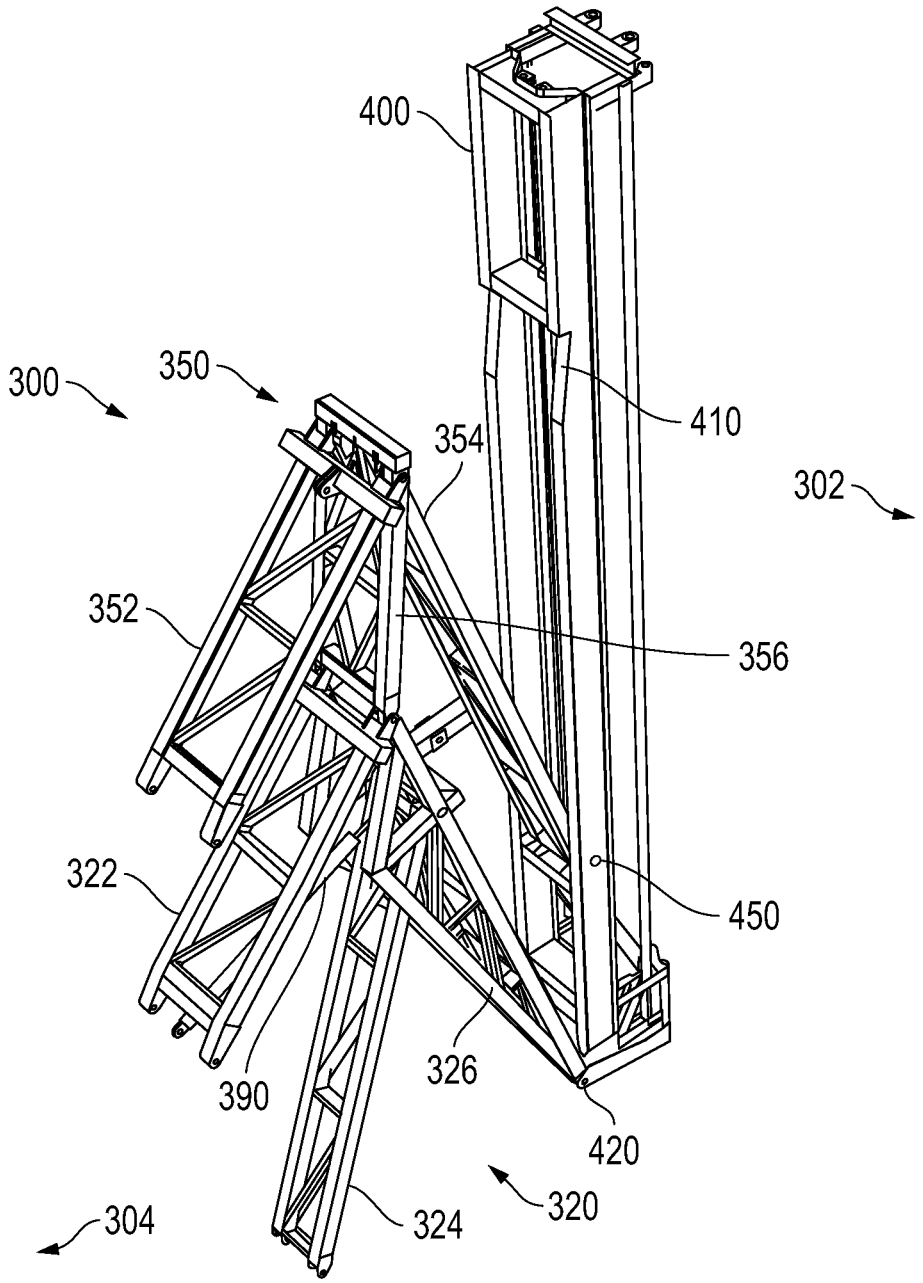
FIG. 6 is an isometric view of the lateral extend mechanism of the racking mechanism illustrating the lateral extend mechanism in isolation of the remaining components of the racking mechanism and of the drilling rig.

FIG. 6 is an isometric view of lateral extend mechanism 300 of FIG. 1, illustrating lateral extend mechanism 300 in isolation of the remaining components of racking mechanism 100 and of drilling rig 10. As shown in FIG. 6, lateral extend mechanism 300 has a mast side 302 and a base connect side 304. Base connect side 304 of lateral extend mechanism 300 is pivotally connected to base frame 200 (not shown). Mast side 302 of lateral extend mechanism 300 is pivotally connected to pivot frame 400 at connections 420 and 450.

In the preferred embodiment illustrated, lateral extend mechanism 300 comprises an extend linkage 320 and a level linkage 350. In a more preferred configuration, lateral extend mechanism 300 comprises an eight bar linkage as illustrated.

In the preferred embodiment illustrated, extend linkage 320 is comprised of an upper link 322, a lower link 324, and a long link 326. Also in this embodiment, level linkage 350 is comprised of an inboard link 352, an outboard link 354, and a coupler link 356.

Extend linkage 320 and level linkage 350 are pivotally connected to base frame 200 (not shown) on base connect side 304. Extend linkage 320 and level linkage 350 are pivotally connected to pivot frame 400 on mast side 302. Extend linkage 320 is pivotally connected to pivot frame 400 at connection 420. Level linkage 350 is pivotally connected to pivot frame 400 at connection 450. Extend linkage 320 and level linkage 350 are also pivotally connected to each other by coupler link 356.

A lateral extend cylinder 390 is pivotally connected between base frame 200 (not shown) and extend linkage 320. Controllable expansion of lateral extend cylinder 390 moves lateral extend mechanism 300 and thus pivot frame 400 between a retracted position substantially internal to base frame 200 (not shown) and an extended position external to base frame 200. In a preferred embodiment, inboard link 352 and upper link 322 are substantially the same length. The novel kinematic configuration of extend linkage 320 and level linkage 350 generates extension of pivot frame 400 along a stable and substantially horizontal path above drill floor 14 (not shown) when lateral extend mechanism 300 is deployed.

The lateral extend mechanism 300 is useful for other drilling rig applications in which it is desirable to horizontally translate another apparatus in a self-balancing manner in which maintaining the vertical alignment of the apparatus is desired. Such applications include positioning a gripping or torque device.

As seen in FIG. 6, pivot frame 400 is in the form of a C-frame, with an opening in the direction of mast side 302 for receiving rotate frame 600 (not shown) and its connected contents.

Figure 7:
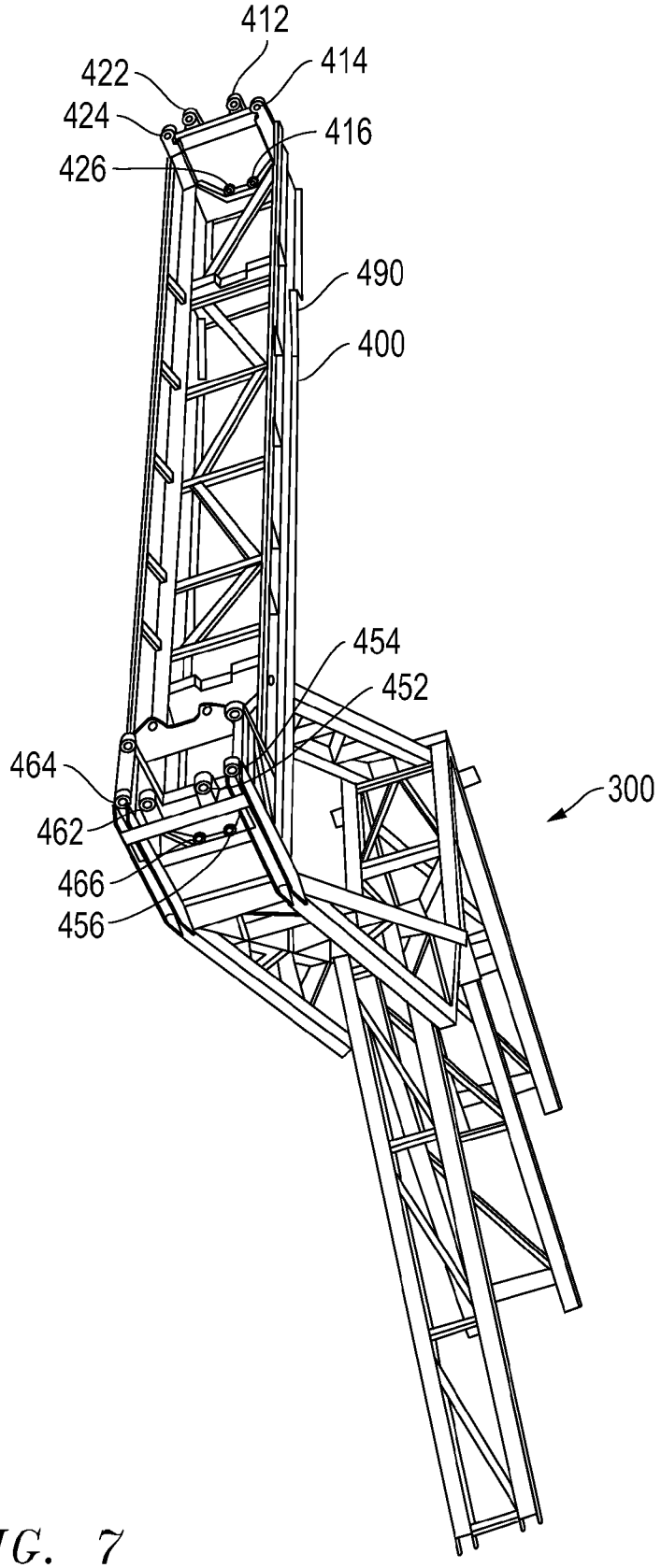
FIG. 7 is an isometric view of the pivot frame illustrated in isolation of the remaining components of the racking mechanism and of the drilling rig.

FIG. 7 is an isometric view of lateral extend mechanism 300 from FIG. 6, shown from the opposite side, with pivot frame 400 in front, and shown from below. Pivot frame 400 has a plurality of sockets for pivotal connection to the linkage of rotate mechanism 500.

In one embodiment as shown, at the top of pivot frame 400 is a right lock socket 412, a right drive link socket 414, and a right cylinder socket 416 which are located near the top of pivot frame 400. A left lock socket 422, a left drive link socket 424, and a left cylinder socket 426 are also located near the top of pivot frame 400.

A right lock socket 452, a right drive link socket 454, and a right cylinder socket 456 are located near the bottom of pivot frame 400, and in respective axial alignment with right lock socket 412, right drive link socket 414, and right cylinder socket 416 at the top of pivot frame 400.

A left lock socket 462, a left drive link socket 464, and a left cylinder socket 466 are located near the bottom of pivot frame 400, and in respective axial alignment with left lock socket 422, left drive link socket 424, and left cylinder socket 426 at the top of pivot frame 400.

In one embodiment illustrated in FIG. 7, a notch 490 on pivot frame 400 is receivable of level linkage 350 of lateral extend mechanism 300. A similarly sized notch 410 (not seen) is located on the corresponding side of the pivot frame 400. Engagement of notch 490 (and notch 410) with level linkage 350 stabilizes pivot frame 400 and other components of racking mechanism 100 when lateral extend mechanism 300 is fully retracted.

Figure 8:
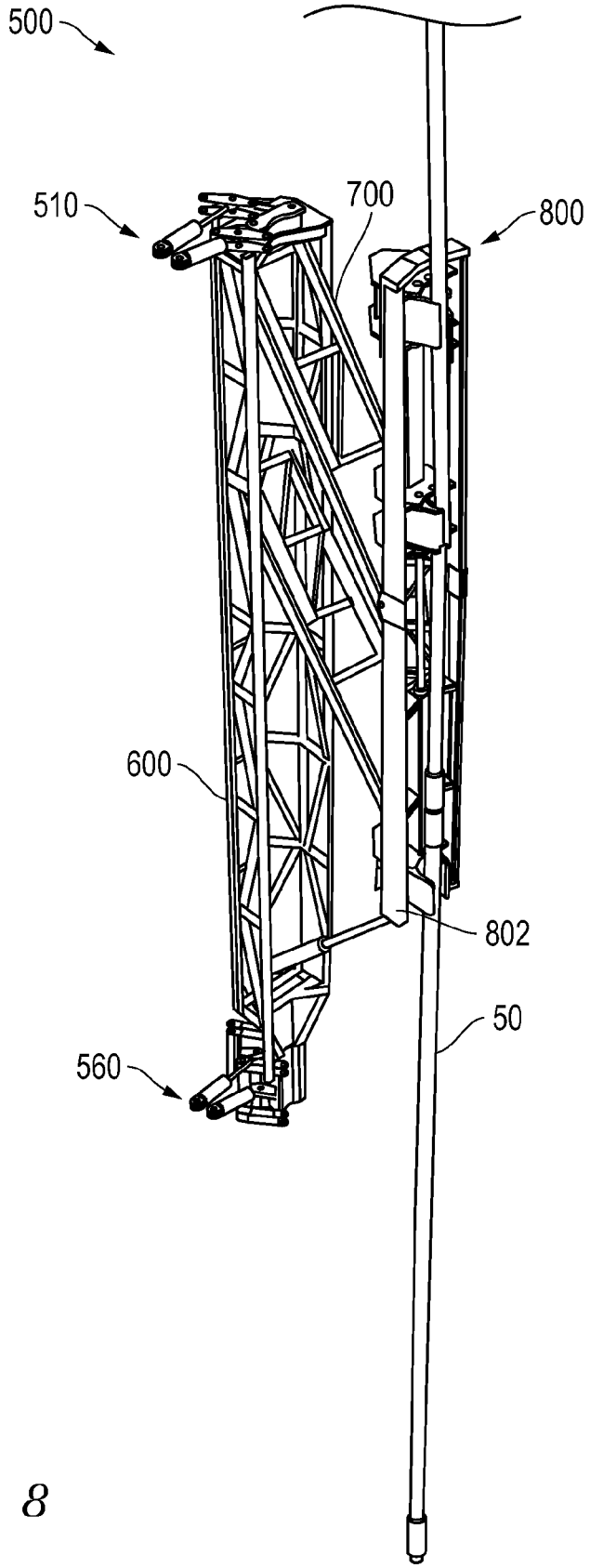
FIG. 8 is an isometric view of the rotate mechanism, finger extend mechanism and vertical grip and stab mechanism of the racking mechanism.
Figure 9:
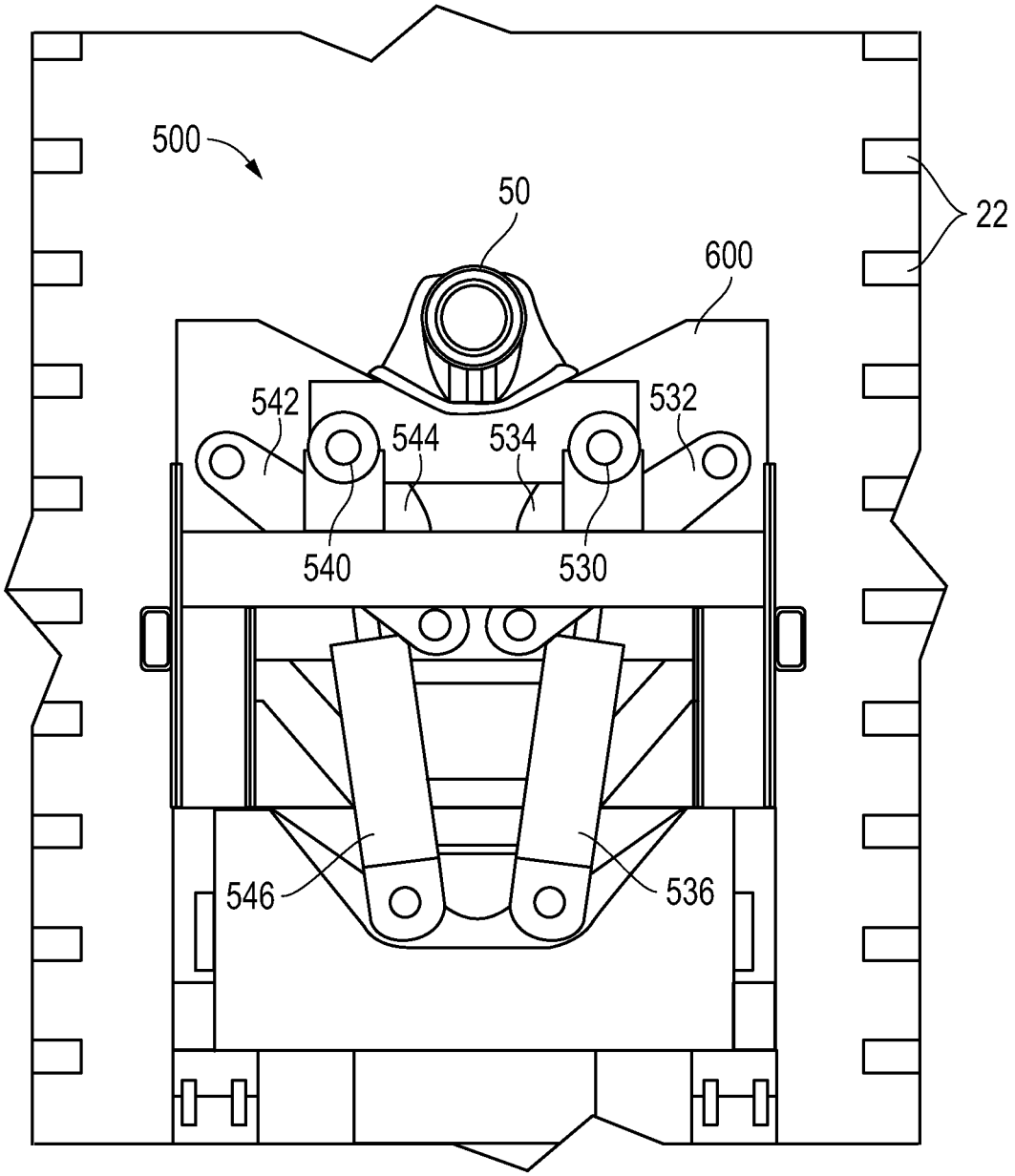
FIG. 9 is a top view of the rotate mechanism illustrating the rotate mechanism in the non-rotated position, and having the finger extend and gripping mechanisms retracted.

FIG. 8 is an isometric view of the components of racking mechanism 100, shown without lateral extend mechanism 300 and pivot frame 400. As illustrated in FIG. 9, a rotate mechanism 500 is shown for connection to pivot frame 400. A rotate frame 600 comprises the body of the rotate mechanism 500. A top rotate mechanism 510 and bottom rotate mechanism 560 are also shown connected to the rotate mechanism 500, and used for connection to the pivot frame 400. A finger extend mechanism 700 is connected to rotate mechanism 500. A grip and stab mechanism 800 is connected to rotate mechanism 500 via the finger extend mechanism 700. FIG. 3 illustrates rotate mechanism 500 rotated 90 (ninety) degrees; with finger extend mechanism 700 in the retracted position. This position is intermediate of positions for receiving or setting back a stand of drill pipe in racking board 20.

Figure 10:
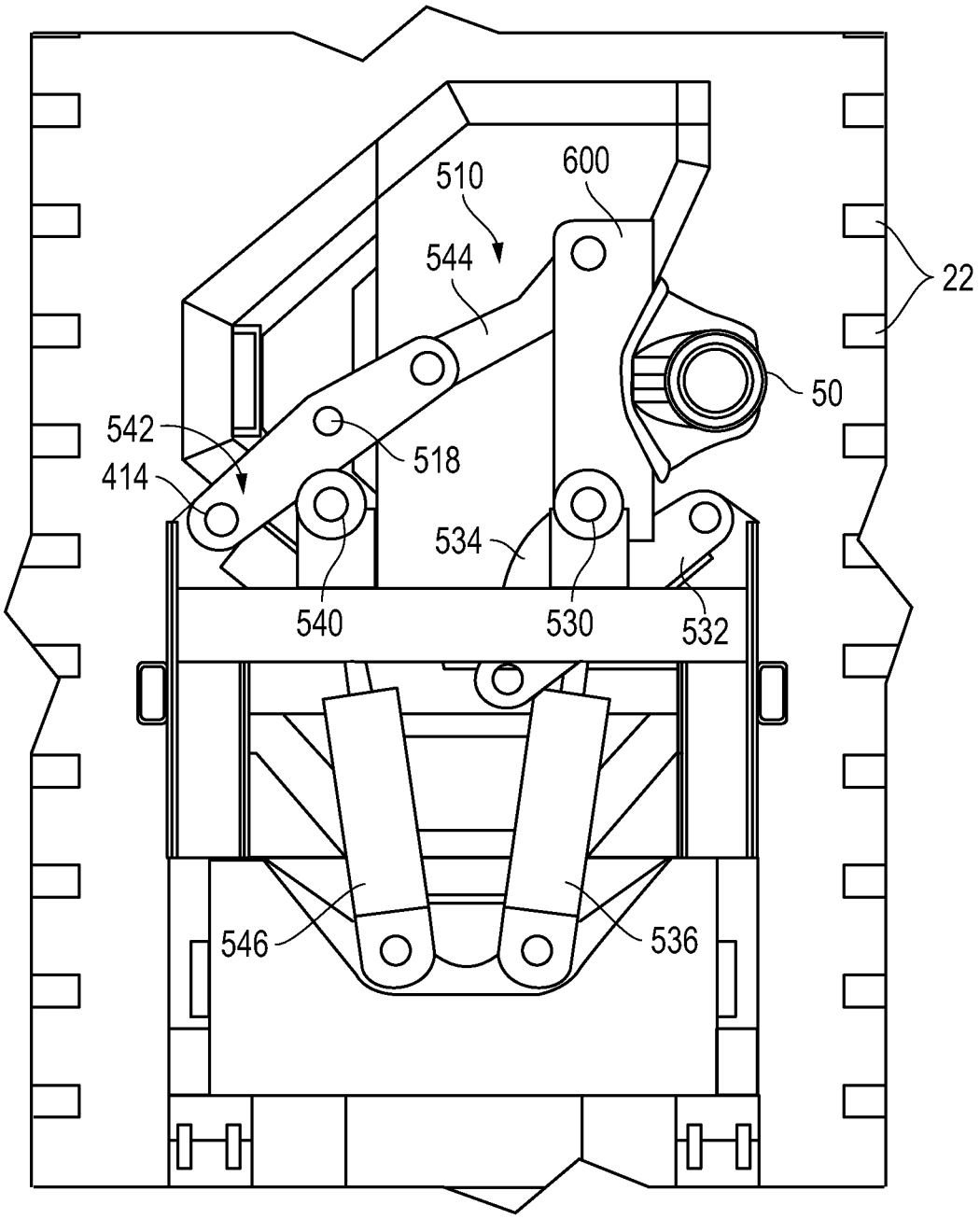
FIG. 10 is a top view of the rotate mechanism illustrating the rotate mechanism rotated 90 (ninety) degrees, and having the finger extend and gripping mechanisms retracted.

FIG. 9 is a top view of rotate mechanism 500, illustrating top rotate mechanism 510 (not shown) in the non-rotated position. FIGS. 9 and 10 illustrate one embodiment in which pivot frame 400 (not shown) is operably connected to rotate mechanism 500.

As best seen in FIG. 9, top rotate mechanism 500 comprises a right driver 532 pivotally connected to pivot frame 400 (not shown) at right drive socket 414 (not shown) on one end and pivotally connected to a right coupler 534 on its opposite end. Right coupler 534 is pivotally connected between right driver 532 and rotate frame 600. An expandable right cylinder 536 has one end pivotally connected to pivot frame 400 at right cylinder socket 416 (not shown). The opposite end of right cylinder 536 is pivotally connected to right driver 532 between its connections to pivot frame 400 and right coupler 534. A right rotate lock pin 530 is provided for engagement with pivot frame 400 at right lock socket 412.

As also seen in FIG. 9, top rotate mechanism 500 comprises a left driver 542 pivotally connected to pivot frame 400 at left drive link socket 424 (not shown) on one end and to a left coupler 544 on its opposite end. Left coupler 544 is pivotally connected between left driver 542 and rotate frame 600. An expandable left cylinder 546 has one end pivotally connected to pivot frame 400 at left cylinder socket 426. The opposite end of left cylinder 546 is pivotally connected to left driver 542 between its connections to pivot frame 400 and left coupler 544. A left rotate lock pin 540 is provided for engagement with pivot frame 400 at left lock socket 422 (not shown).

A substantially matching configuration to the linkage and sockets of top rotate mechanism 510 is provided for bottom rotate mechanism 560. In this manner, top rotate mechanism 510 and bottom rotate mechanism 560 work in parallel relation to turn rotate frame 600 of rotate mechanism 500 in the desired direction.

To provide selectable rotation direction, or non-rotated direction, rotate mechanism 500 is connected to pivot frame 400, in part, by selectable rotate lock pins 530 and 540. Rotate frame 600 is clockwise rotatable about a first vertical axis centered on right lock socket 452 of pivot frame 400. Rotate frame 600 is counterclockwise rotatable about a second vertical axis centered on left lock socket 462 of pivot frame 400.

As illustrated in FIG. 9, right rotation of rotate mechanism 500 is caused by actuation of right rotate lock pin 530 into right lock socket 440 (not shown) of pivot frame 400. Subsequent expansion of right cylinder 536 forces right driver 532 to push right coupler 534, which pushes out one end of rotate frame 600. Since the other end of rotate frame 600 is pivotally attached to pivot frame 400 by right rotate lock pin 530 in right lock socket 412, rotate frame 600 rotates to the right.

Similarly, left rotation of rotate mechanism 500 is caused by actuation of left rotate lock pin 540 into left lock socket 422 (not shown) of pivot frame 400. Subsequent expansion of left cylinder 546 forces left driver 542 to push left coupler 544, which pushes out one end of rotate frame 600. Since the other end of rotate frame 600 is pivotally attached to pivot frame 400 by left rotate lock pin 540 in left lock socket 462, rotate frame 600 rotates to the left.

Rotate frame 600 can be locked into non-rotated position by actuation of right rotate lock pin 530 into right lock socket 412 of pivot frame 400, and actuation of left rotate lock pin 540 into left lock socket 422 of pivot frame 400.

As previously stated, the same kinematic relationships are engaged in top rotate mechanism 510 and bottom rotate mechanism 560 so that they may work in parallel relation to turn rotate frame 600 in the desired direction.

FIG. 10 is a top view of rotate mechanism 500. Rotate mechanism 500 comprises a rotate frame 600, a top rotate linkage 510 and a bottom rotate linkage 560 (not shown). Top rotate linkage 510 and bottom rotate linkage 560 pivotally connect rotate frame 600 to pivot frame 400 (not shown). Top rotate linkage 510 and bottom rotate linkage 560 work in parallel relation to turn rotate frame 600 at least 90 (ninety) degrees in a selectable clockwise or counterclockwise direction in relation to pivot frame 400.

Figure 11:
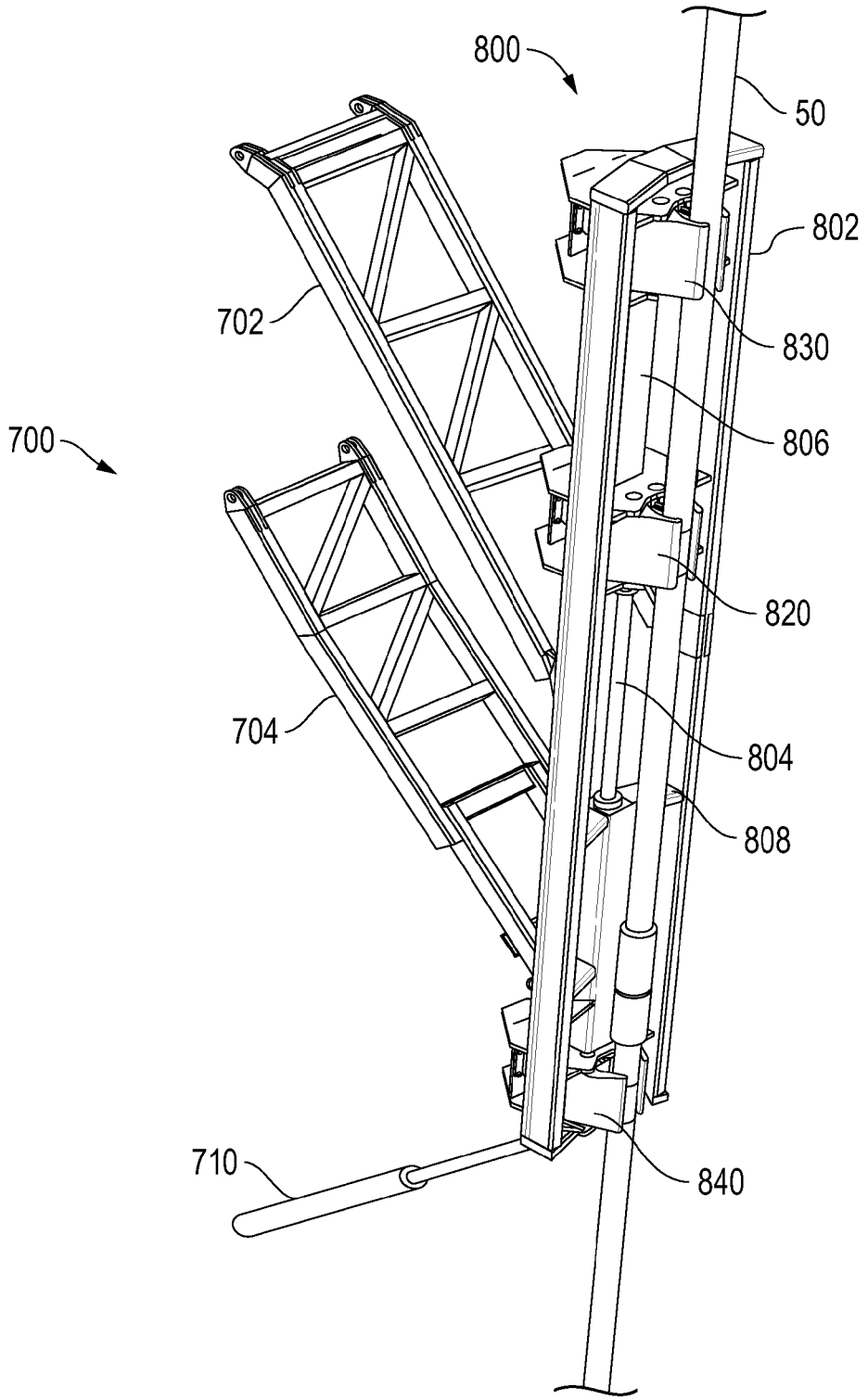
FIG. 11 is an isometric view of the finger extend mechanism and vertical grip and stab mechanism of the racking mechanism.

FIG. 11 is an isometric view of finger extend mechanism 700 and vertical grip and stab mechanism 800. Finger extend mechanism 700 is pivotally connected to rotate frame 600 (not shown). Finger extend mechanism 700 is extendable between a retracted position substantially within rotate frame 600 and a deployed position, which extends outward in the selected direction of rotate mechanism 500, away from rotate frame 600. Referring back to FIG. 4, as compared to FIG. 3, finger extend mechanism 700 is partially deployed.

In the preferred embodiment, finger extend mechanism 700 is collapsible within rotate frame 600 such that rotate frame 600, finger extend mechanism 700 and vertical grip and stab mechanism 800 are collectively 180 (one hundred eighty) degrees rotatable within a 48 inch distance.

Finger extend mechanism 700 includes an upper finger extend frame 702 pivotally connected on its upper end to rotate frame 600 and pivotally connected on its lower end to a vertical stab frame 802 of vertical grip and stab mechanism 800. Finger extend mechanism 700 includes a lower finger extend frame 704 pivotally connected on its upper end to rotate frame 600 and pivotally connected on its lower end to vertical stab frame 802. A finger extend cylinder 710 is pivotally connected on a first end to vertical stab frame 802, and connected on a second end to rotate mechanism 500. Extension of finger extend cylinder 710 causes extension of finger extend mechanism 700 and movement of vertical grip and stab mechanism 800 away from rotate frame 500 to position pipe 50 in the desired position.

As stated, vertical grip and stab mechanism 800 has a vertical stab frame 802. Vertical stab frame 802 has a lower end and an opposite upper end. A stab cylinder 804 is located on vertical stab frame 802.

A lower load gripper 820 is mounted in vertically translatable relation to vertical stab frame 802. A spacer 806 is attached above lower load gripper 820. An upper load gripper 830 is mounted above spacer 806, in vertically translatable relation to vertical stab frame 802. Load grippers 820 and 830 are capable of clamping onto the exterior of a drilling tubular and supporting the load of the tubular. Extension of stab cylinder 804 moves lower load gripper 820, spacer 806, and upper load gripper 830 vertically upwards in relation to vertical stab frame 802.

A spring assembly 808 is located between stab cylinder 804 and centering gripper 840. Spring assembly 808 is preloaded with the weight of the lower load gripper 820 and upper load gripper 830. The spring is further loaded when lower load gripper 820 and upper load gripper 830 are used to grip pipe 50, and stab cylinder 804 is extended. This reduces the power required for extending stab cylinder 804 to raise pipe 50. In one embodiment, spring assembly 808 is designed to achieve maximum compression under a weight of approximately 2,000 pounds, which is approximately the weight of a standard drill string.

Preloading spring assembly 808 allows for a gradual load transfer of the vertical forces from stab cylinder 804 to the target support of pipe 50, being either a receiving toll joint of drill pipe stump 52 located in wellbore 12, or on drill floor 14 for setting back the stand of drill pipe 50.

A centering gripper 840 is located on the lower end of vertical stab frame 802. Centering gripper 840 stabilizes pipe 50, while allowing it to translate vertically through its centering grip.

In an alternative embodiment (not illustrated), a gripper assembly is mounted in vertically translatable relation to vertical stab frame 802. At least one load gripper 830 is mounted on the gripper assembly. In this embodiment, extension of stab cylinder 804 moves the gripper assembly, including load gripper 830, vertically upwards in relation to vertical stab frame 802.

FIGS. 12 through 22 are top views illustrating the operation of racking mechanism 100 and illustrating racking mechanism 100 moving from a fully retracted position to retrieve a stand of pipe 50 (or other tubular) from pipe rack 20, and delivering pipe stand 50 into alignment for vertical stabbing into drill pipe stump 52 located over wellbore 12. In each of FIGS. 12 through 22, substantial structure has been removed for the purpose of more clearly illustrating the operation of racking mechanism 100, with emphasis of the relationship between racking mechanism 100, pipe rack 20, pipe stand 50, and drill pipe stump 52.

Figure 12:
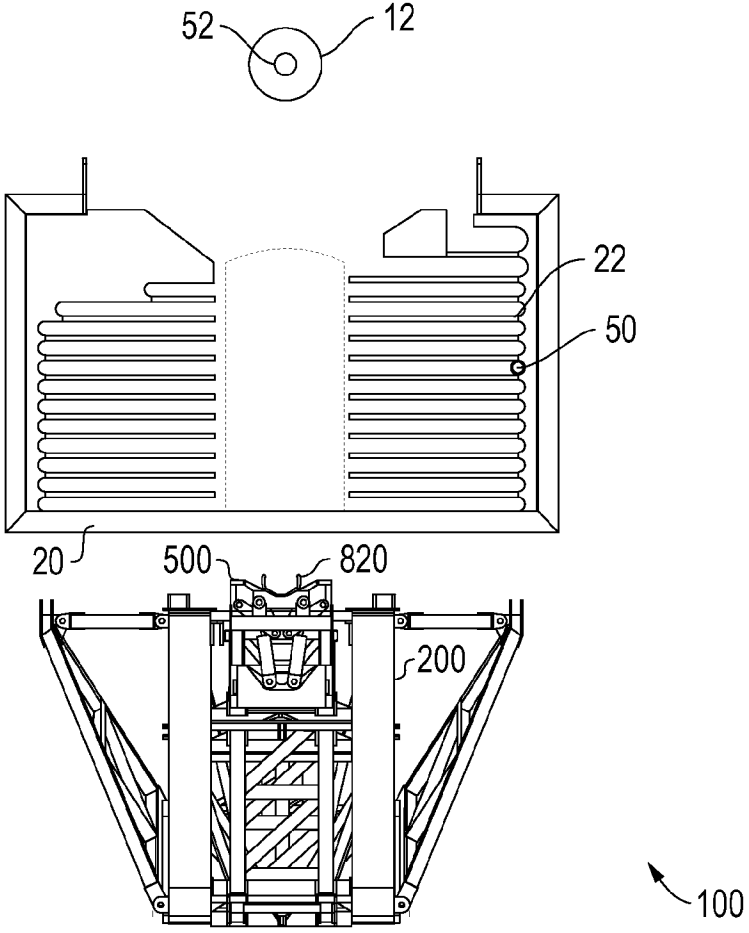

In FIG. 12, racking mechanism 100 is illustrated in the fully retracted position. In this position, the lateral extend mechanism 300 (not seen), rotate mechanism 500, finger extend mechanism 700 (not seen), and grip and stab mechanism 800 are all fully retracted. In this position, racking mechanism 100 can be serviced. Rotate mechanism 500 can also be rotated and lateral extend mechanism 300 can be extended to permit racking mechanism 100 to be used to lift other drilling rig equipment. It is possible to replace grip and stab mechanism 800 with an alternative gripping device for this purpose.

Figure 13:
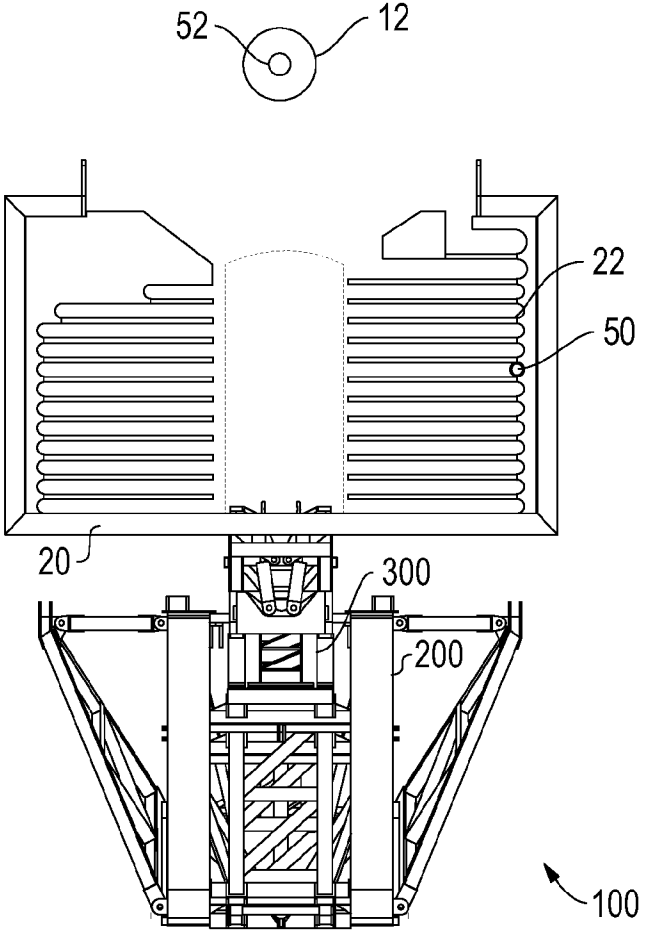
FIGS. 12 through 22 are top views illustrating operation of the automatic pipe racker and illustrating the automatic pipe racker moving from a fully retracted position, to retrieve a stand of pipe (or other tubular) from the pipe rack, to an extended position and delivering the pipe stand into alignment for vertical stabbing into the stump over the wellbore.

FIG. 13 illustrates racking mechanism 100 having lateral extend mechanism 300 partially extended. In this position, racking mechanism 100 can be parked for immediate access to pipe 50 in racking board 20 when needed.

Figure 14:
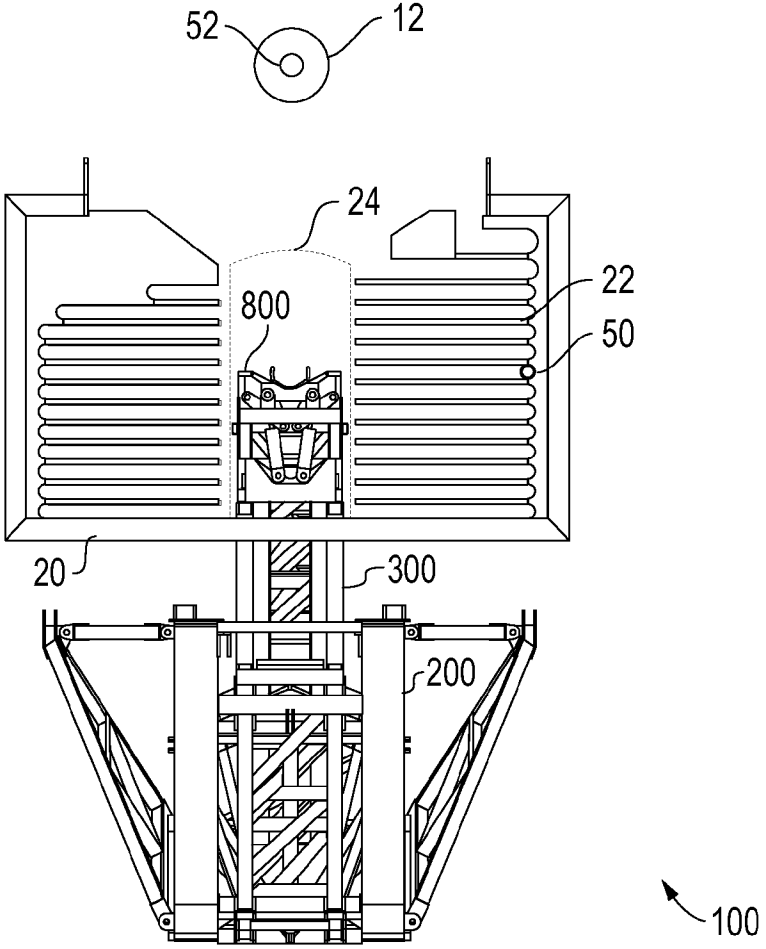

FIG. 14 illustrates racking mechanism 100 in a partially extended position as racking mechanism 100 progresses towards pipe 50 which is resting in racking board 20. In this position, the lateral extend mechanism 300 is partially extended and rotate mechanism 500, finger extend mechanism 700, and grip and stab mechanism 800 are extended to a position beneath diving board 24.

Figure 15:
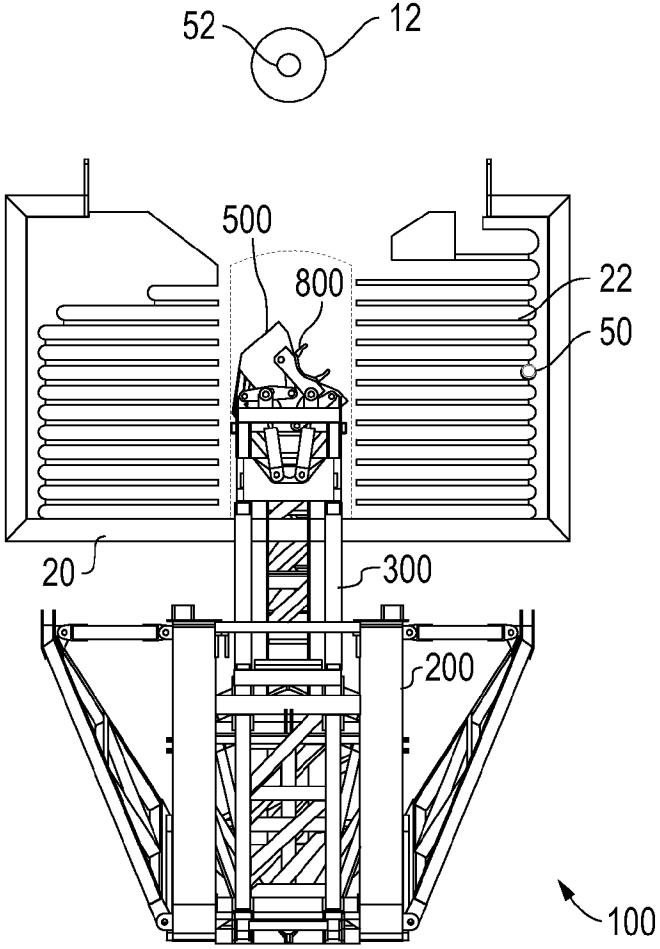
Figure 16:
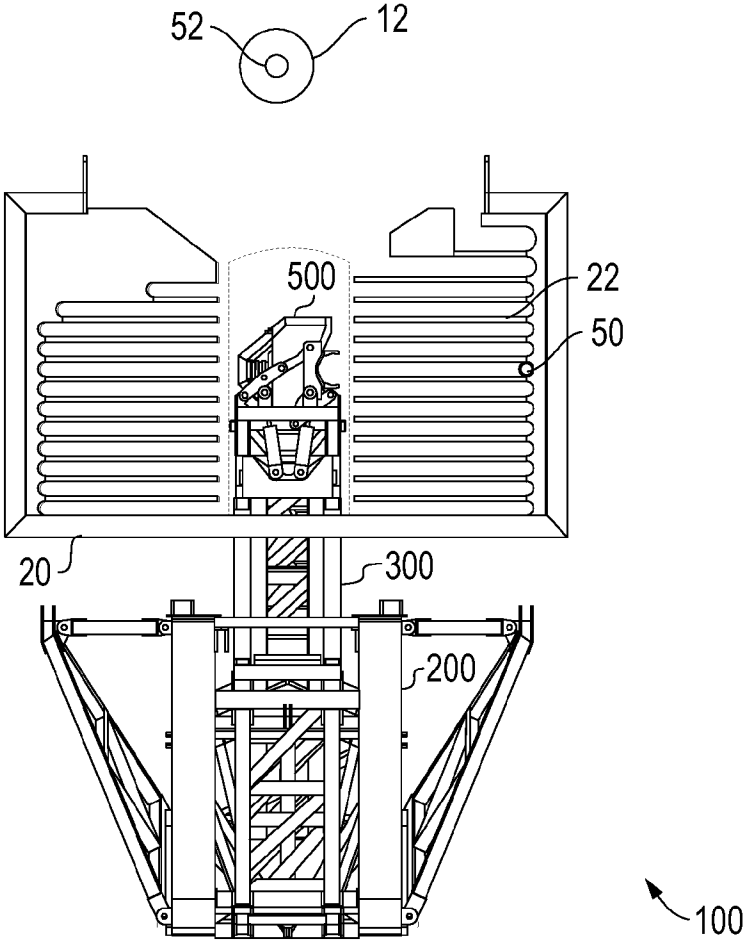

FIG. 15 illustrates racking mechanism 100 with rotate mechanism 500 partially rotated to the right towards pipe 50. FIG. 16 illustrates rotate mechanism 500 rotated 90 (ninety) degrees and now orienting grip and stab mechanism 800 such that grippers 820, 830, and 840 are open and facing pipe 50.

Figure 17:
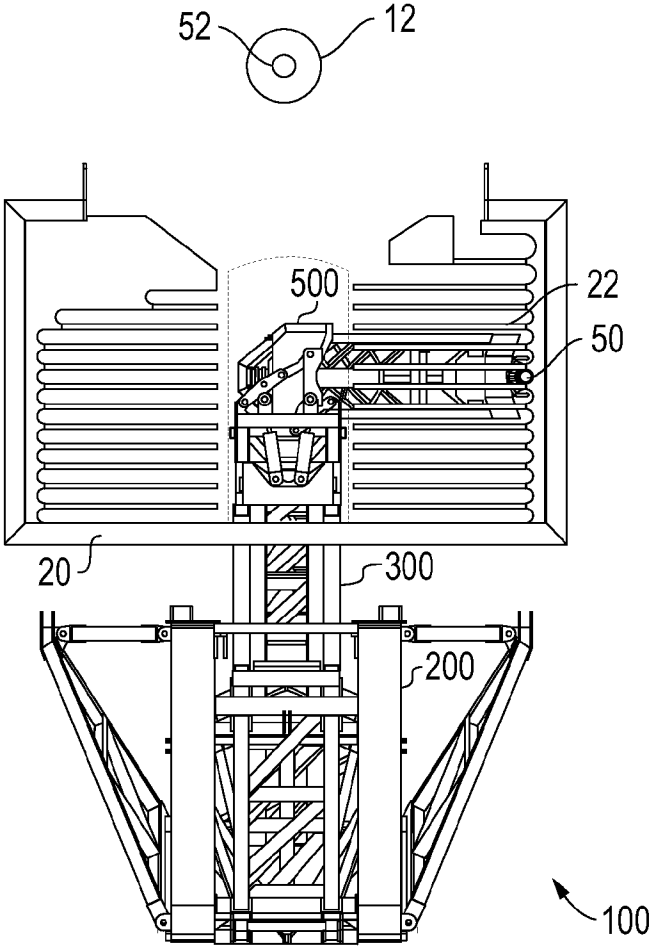

FIG. 17 illustrates racking mechanism 100 having finger extend mechanism 700 fully extended to position grip and stab mechanism 800 adjacent to pipe 50. Grippers 820, 830, and 840 are closed around pipe 50. Stab cylinder 804 is extended and pipe 50 is raised off of drilling floor 10, suspended vertically by upper load gripper 830 and lower load gripper 820. Centering gripper 840 resists undesirable bending and oscillation of pipe 50.

Figure 18:
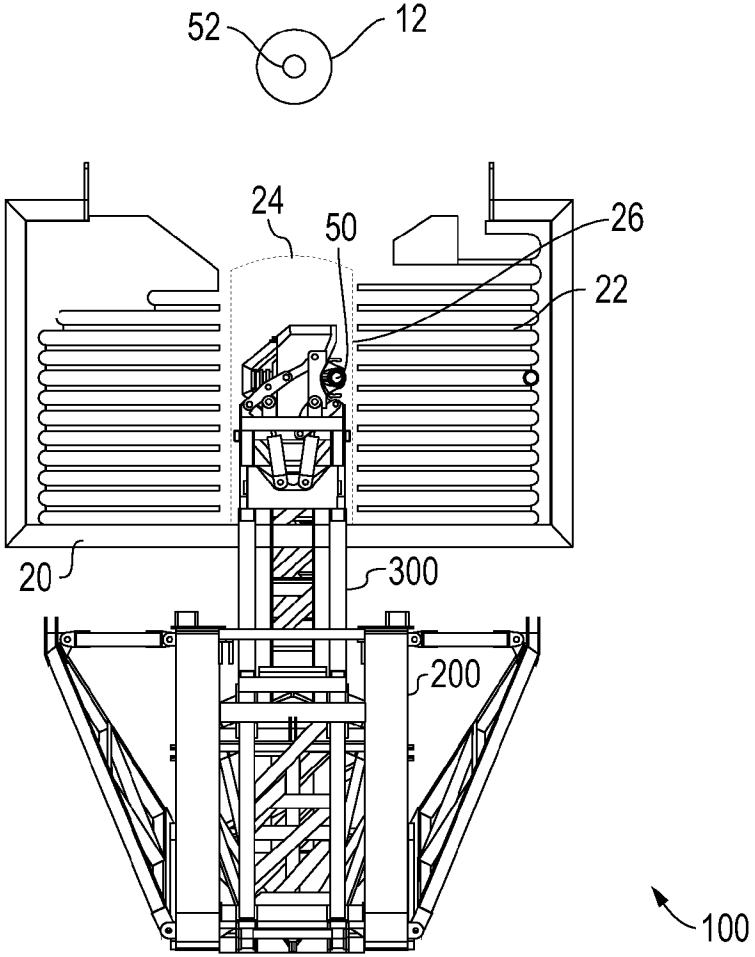

FIG. 18 illustrates racking mechanism 100 having finger extend mechanism 700 retracted to position pipe 50 between diving board 24 and the ends of fingers 22 of racking board 20. Rotate mechanism 500 remains rotated clockwise. A corridor 26 is formed in this space through which pipe 50 must be navigated to avoid conflict with the structure of racking board 20.

Figure 19:
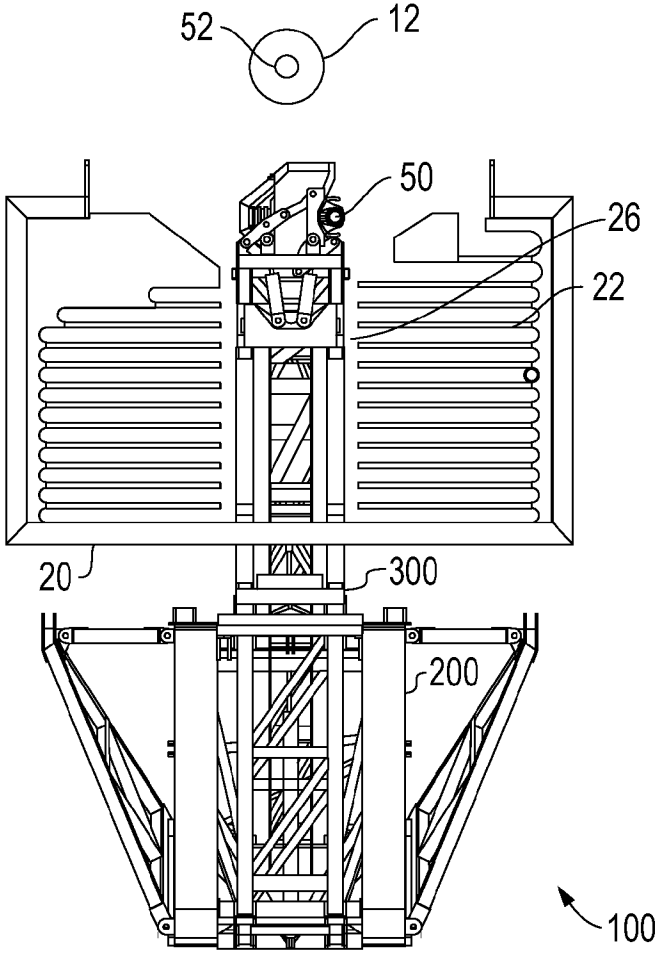

FIG. 19 illustrates racking mechanism 100 having the lateral extend mechanism 300 further extended to guide pipe 50 through corridor 26 towards drill pipe stump 52 in wellbore 12.

Figure 20:
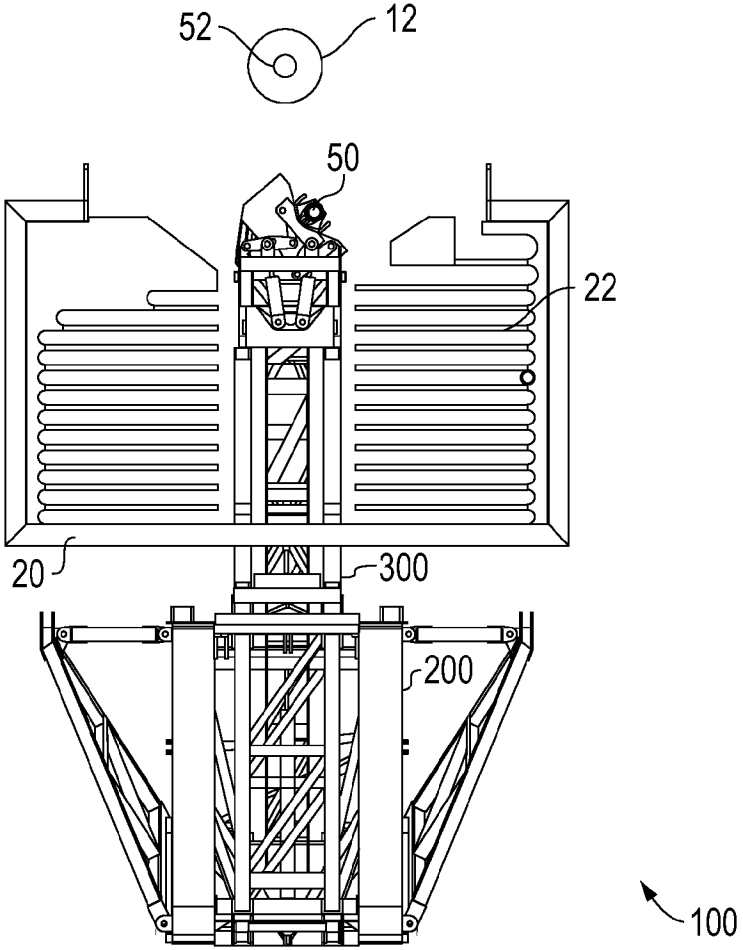

FIG. 20 illustrates racking mechanism 100 having delivered pipe 50 along a substantially horizontal path by the extension of lateral extend mechanism 300. In this position, pipe 50 is now past diving board 24 in the direction of wellbore 12. Rotate mechanism 500 is now rotated counterclockwise to position pipe 50 in alignment with drill pipe stump 52 in wellbore 12.

Figure 21:
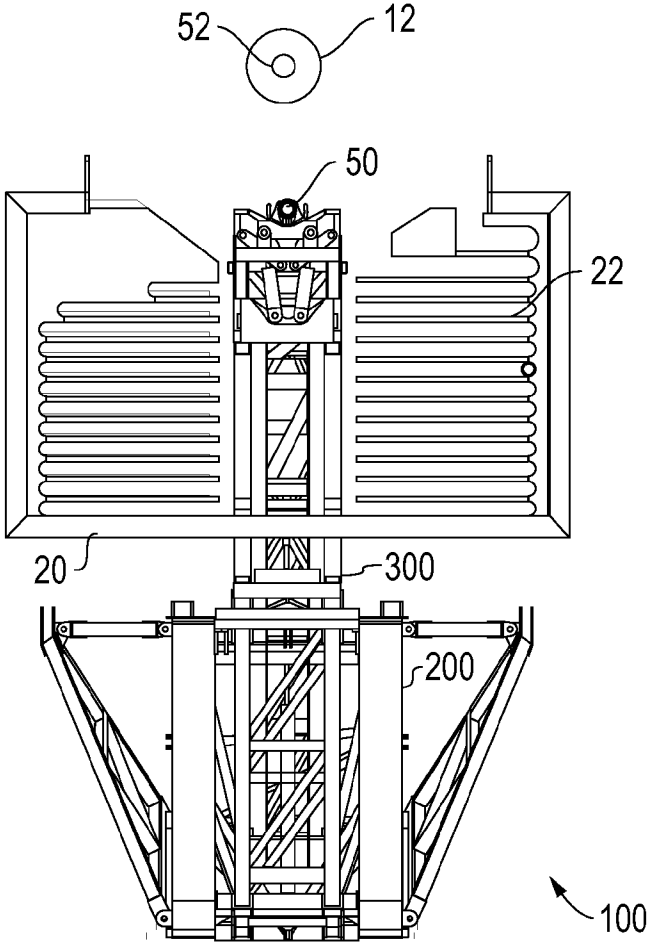

FIG. 21 illustrates racking mechanism 100 having rotate mechanism 500 returned to the forward and non-rotated position, thus aligning pipe 50 for delivery to a position directly above drill pipe stump 52. It is possible to simultaneously actuate rotate mechanism 500 while lateral extend mechanism 300 continues to extend in the direction of drill pipe stump 52 in wellbore 12 to save delivery time.

Figure 22:
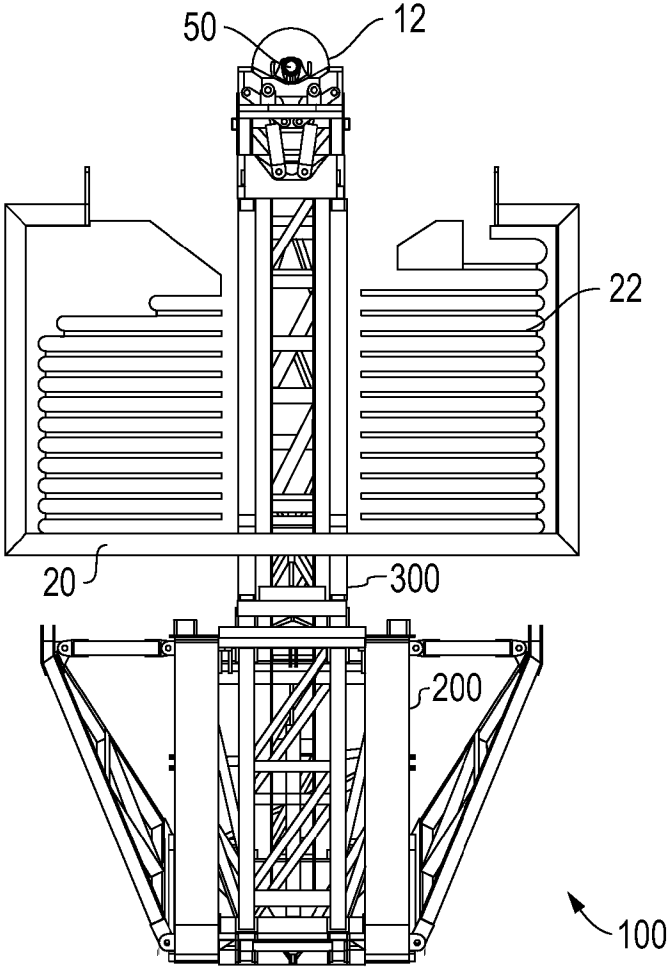

FIG. 22 illustrates racking mechanism 100 having delivered pipe 50 in a vertical position directly above drill pipe stump 52 in wellbore 12. In this position, stab cylinder 804 of grip and stab mechanism 800 is lowered to vertically lower upper load gripper 830 and lower load gripper 820, and thus pipe 50, until the male pin connection of pipe 50 (or other tubular) engages female box connection of drill pipe stump 52. In this position, pipe 50 may be fully connected by rotation and the proper torque into drill pipe stump 52.

FIGS. 23 through 26 are selected side views that correspond to the top views provided in FIGS. 12 through 22.

Figure 23:
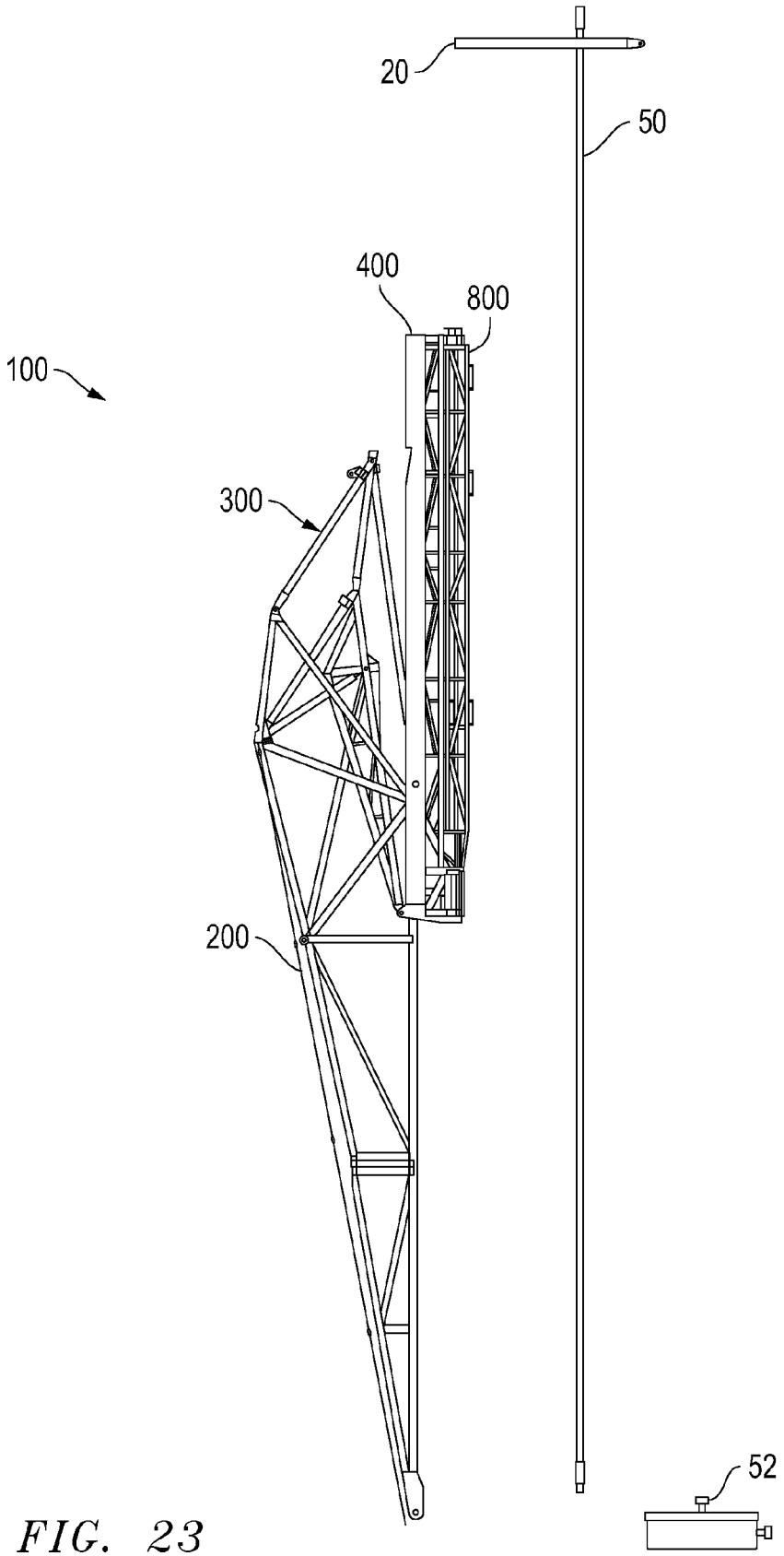
FIG. 23 is a side view of the automatic pipe racking mechanism in the position illustrated in the top view of FIG. 13.

FIG. 23 is a side view of racking mechanism 100 in the position illustrated in the top view of FIG. 13. In this view, racking mechanism 100 is mostly retracted.

Figure 24:
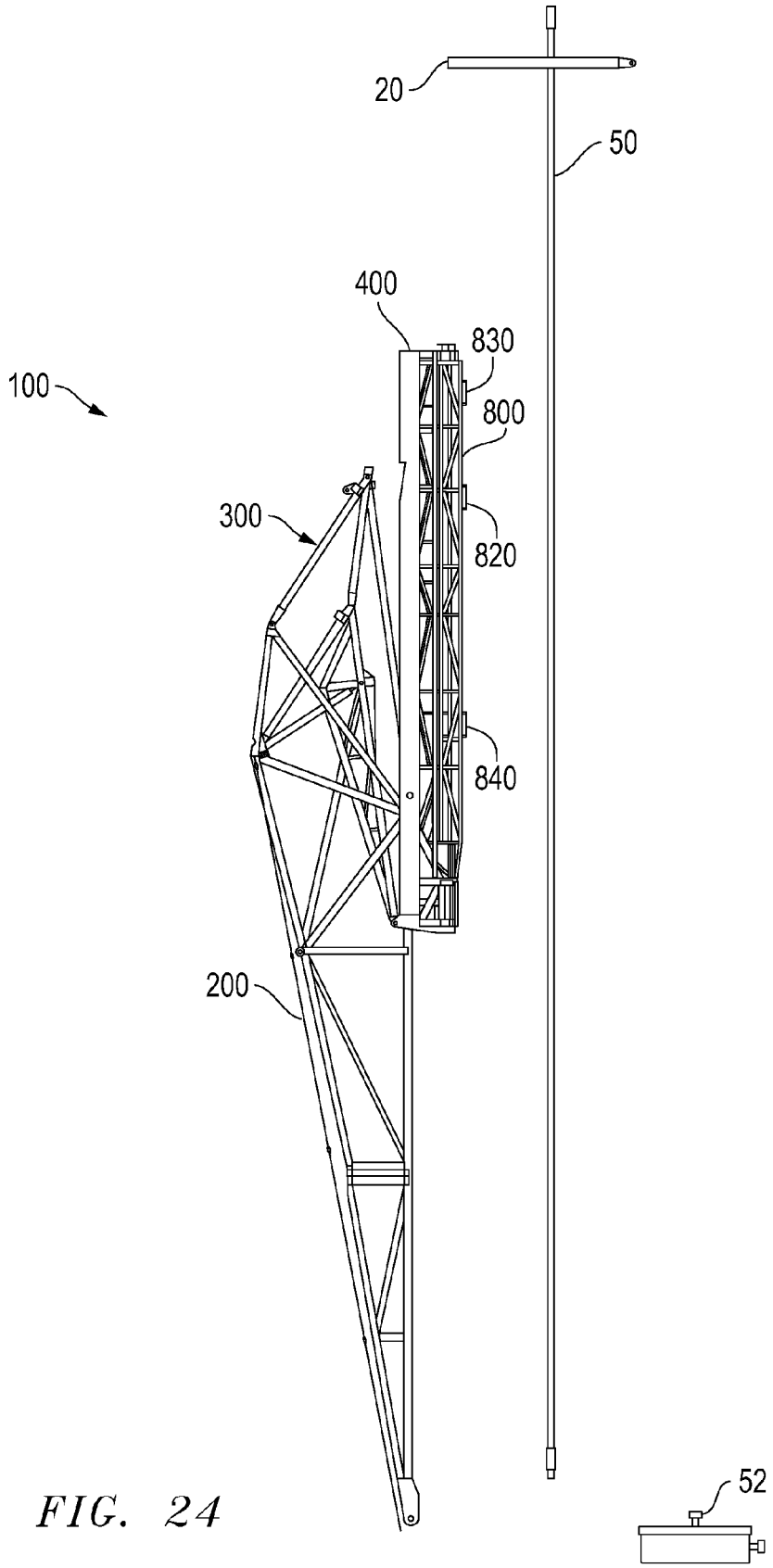
FIG. 24 is a side view of the automatic pipe racking mechanism in the position illustrated in the top view of FIG. 15.

FIG. 24 is a side view of racking mechanism 100 in the position illustrated in the top view of FIG. 15. In this view, lateral extend mechanism 300 is partially extended in the direction of pipe 50, and rotate mechanism 500 is partially rotating to the right towards pipe 50.

Figure 25:
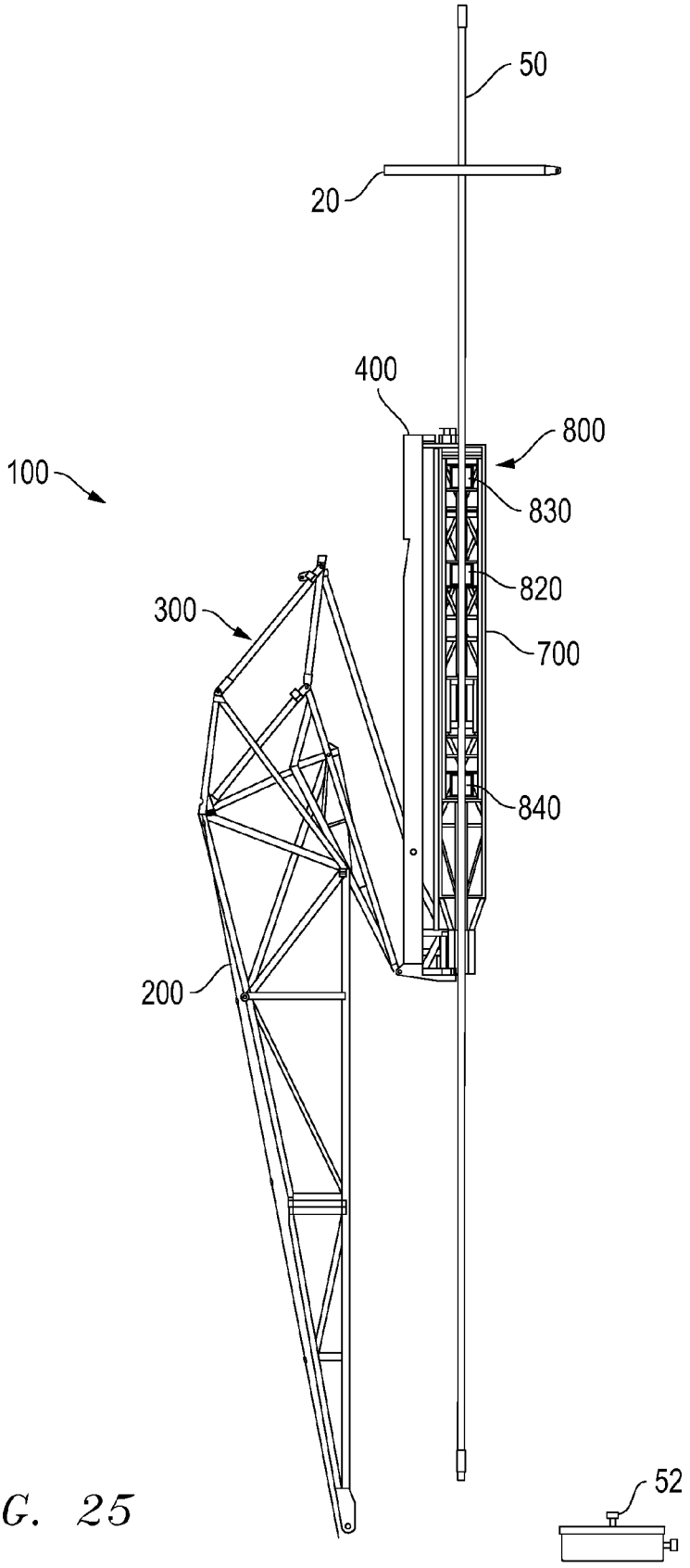
FIG. 25 is a side view of the automatic pipe racking mechanism in the position illustrated in the top view of FIG. 17.

FIG. 25 is a side view of racking mechanism 100 in the position illustrated in the top view of FIG. 17, in which racking mechanism 100 has finger extend mechanism 700 fully extended to position grip and stab mechanism 800 adjacent to pipe 50. Grippers 820, 830, and 840 are closed around pipe 50. Stab cylinder 804 is extended and pipe 50 is raised off of drilling floor 14, suspended vertically by upper load gripper 830 and lower load gripper 820. Centering gripper 840 resists undesirable bending and oscillation of pipe 50.

Figure 26:
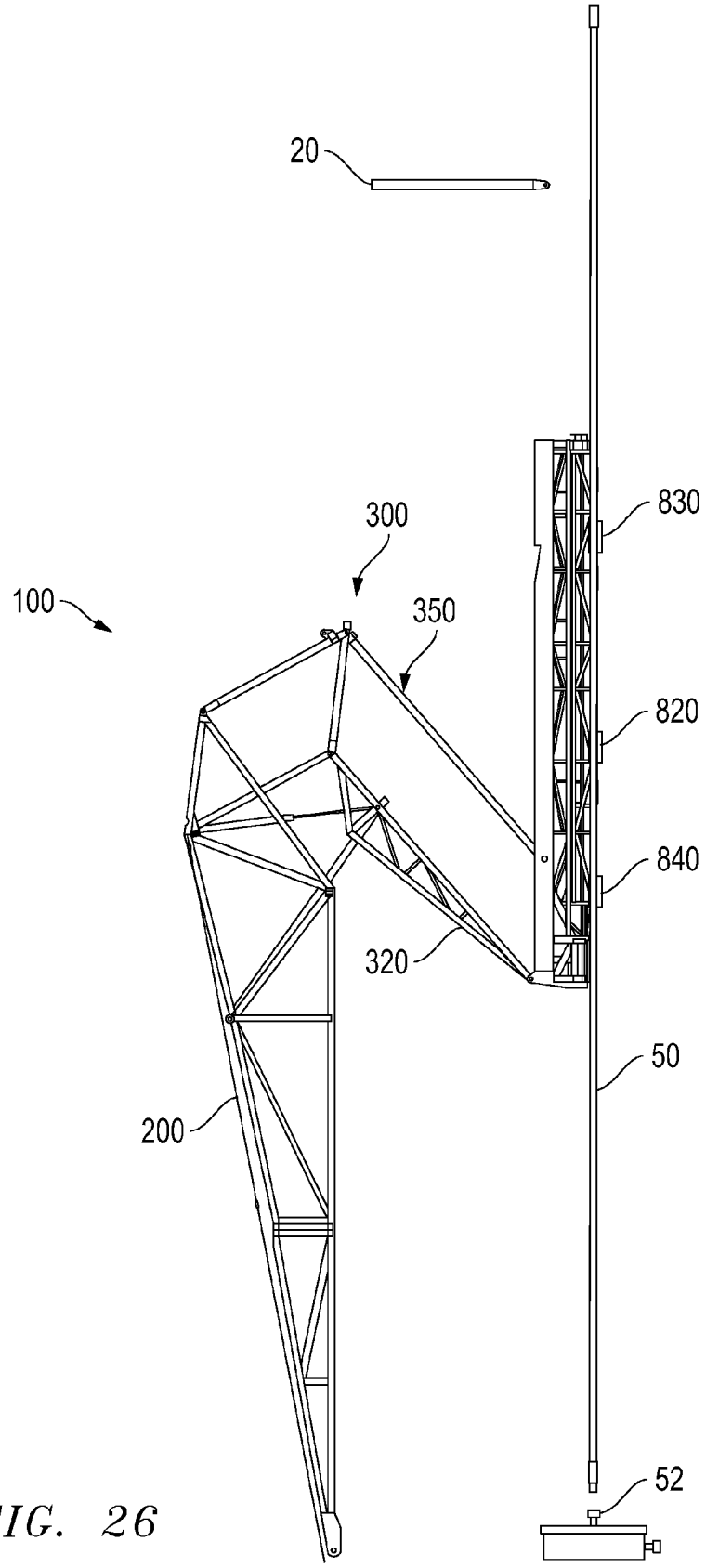
FIG. 26 is a side view of the automatic pipe racking mechanism in the position illustrated in the top view of FIG. 22.

FIG. 26 is a side view of racking mechanism 100 in the position illustrated in top view of FIG. 22, in which automatic pipe racking mechanism 100 has delivered pipe 50 in a vertical position directly above stump 52 in wellbore 12. In this position, stab cylinder 804 of grip and stab mechanism 800 is lowered to vertically lower upper load gripper 830 and lower load gripper 820, and thus pipe 50, until the male pin connection of pipe 50 (or other tubular) engages female box connection of drill pip stump 52. In this position, pipe 50 may be fully connected by rotation and the proper torque into drill pipe stump 52.

Figure 27:
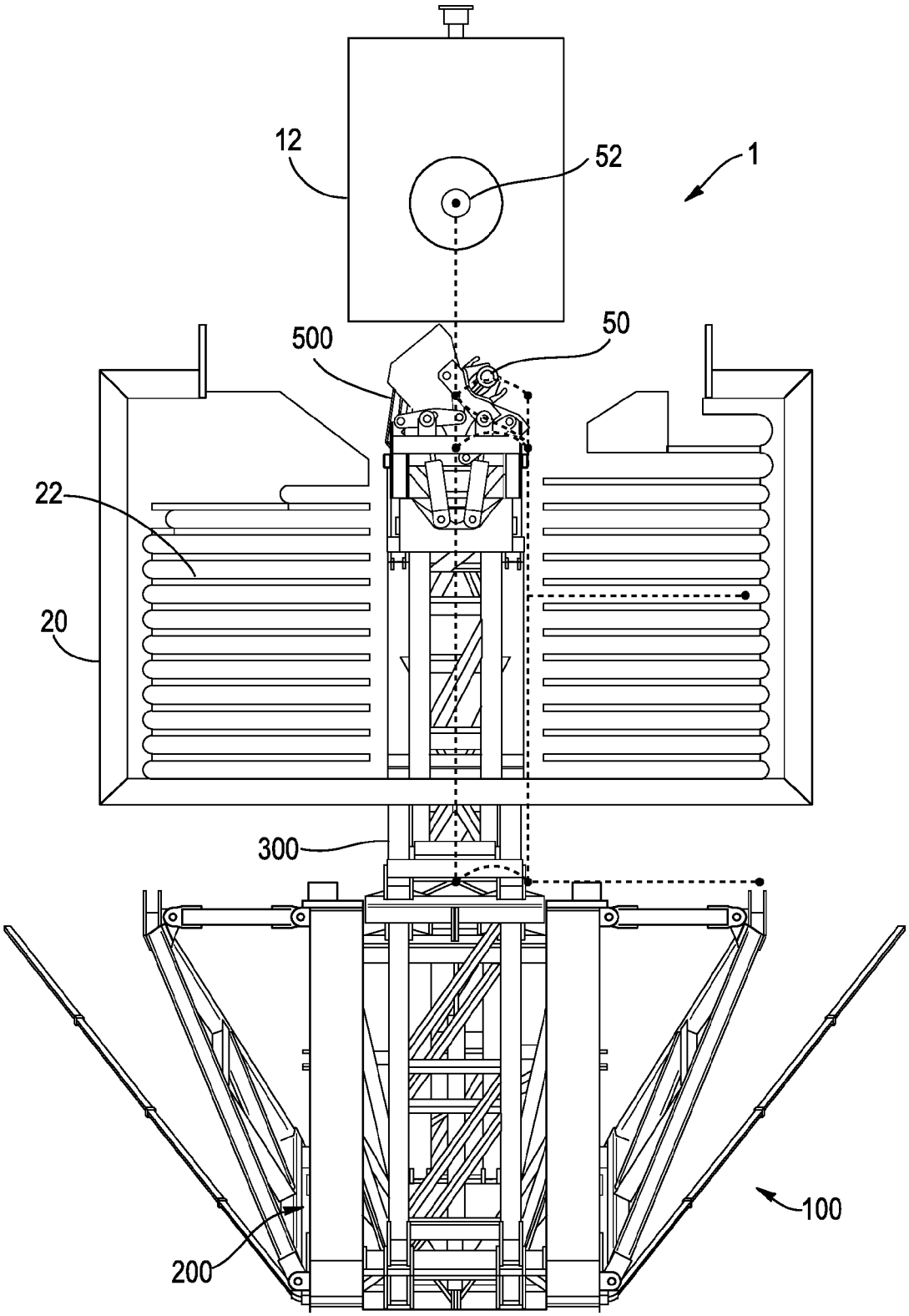
FIG. 27 is a top view illustrating potential paths of a tubular or pipe as manipulated by the pipe racking mechanism.

FIG. 27 is a top view illustrating potential paths of pipe racking mechanism 100 with the dotted line representing the path of drill pipe 50. As seen in FIG. 27, pipe racking mechanism 100 is capable of navigating the narrow space between diving board 10 (see FIG. 24) and fingers 20.

Figure 28:
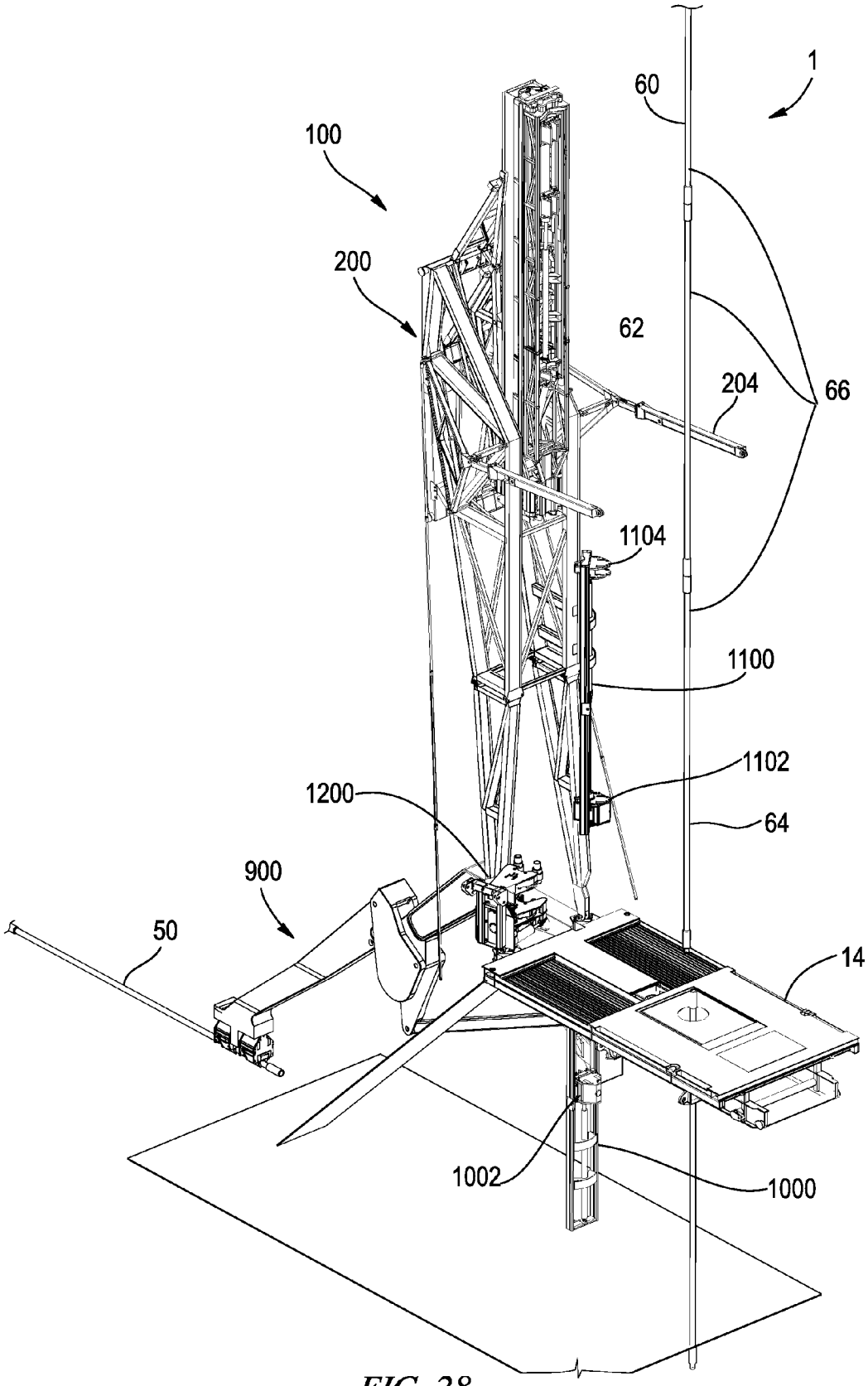
FIG. 28 is an isometric view of a drilling rig floor fitted with a tubular stand building system having features in accordance with the present invention.

FIG. 28 is an isometric view of a drilling rig floor 14 fitted with automatic stand building system 1 having features in accordance with the present invention. As seen in FIG. 28, automatic stand building system 1 comprises a horizontal to vertical mechanism 900, which feeds sections of drill pipe 50 to a lower elevator 1000.

Lower elevator 1000 has at least one gripper 1002 for supporting the load of drill pipe 50. Gripper 1002 of lower elevator system 1000 is vertically translatable along lower elevator 1002. This capability allows gripper 1002 to vertically raise drill pipe 50 to an upper elevator 1100. In one embodiment, the upper end of lower elevator 1000 is pivotally connected to drill rig 10 along a horizontal axis. This connection permits horizontally positioned attachment of lower elevator 1000 in a horizontal position to drill rig 10 prior to raising the substructure of drill rig 10 during rig up. After raising the substructure, lower elevator 1000 may be pivoted into its normal, vertical position.

In one embodiment, upper elevator 1100 is pivotally connected to base frame 200 of pipe racking mechanism 100 along a vertical axis of upper elevator 1100. Upper elevator 1100 has a lower gripper 1102 and an upper gripper 1104. Lower gripper 1104 is vertically translatable along the length of upper elevator 1100. Each of the grippers 1102 and 1104 is capable of supporting the load of three sections of pipe 50. Grippers 1102 and 1104 are independently operable.

A torquing mechanism such as a power tong 1200 may be used to rotate a first section of drill pipe 50 in upper elevator 1100 in respect to a second section of drill pipe 50 in lower elevator 1000. By this procedure, the upper section of the second section of drill pipe 50 and the lower section of the first section of drill pipe 50 are threadedly connected. In an alternative embodiment, one or both of lower elevator 1000 and upper elevator 1100 are fitted with spinning grippers, which are capable of rotating a first section of drill pipe 50 in upper elevator 1100 with respect to a second section of drill pipe 50 in lower elevator 1000.

In one embodiment, the verticality of automatic pipe racking mechanism 100 is controllable in relationship to the mast 16 of drilling rig 10, such as by controllable length adjustment of the mast braces 204. In this embodiment, tipping base frame 200 of automatic pipe racking mechanism 100, and thus also upper elevator 1100 towards mast side 302 of base frame 200 permits entry of a pipe stand 50 into the confines of the racking board 20 of drilling rig 10.

Figure 29:
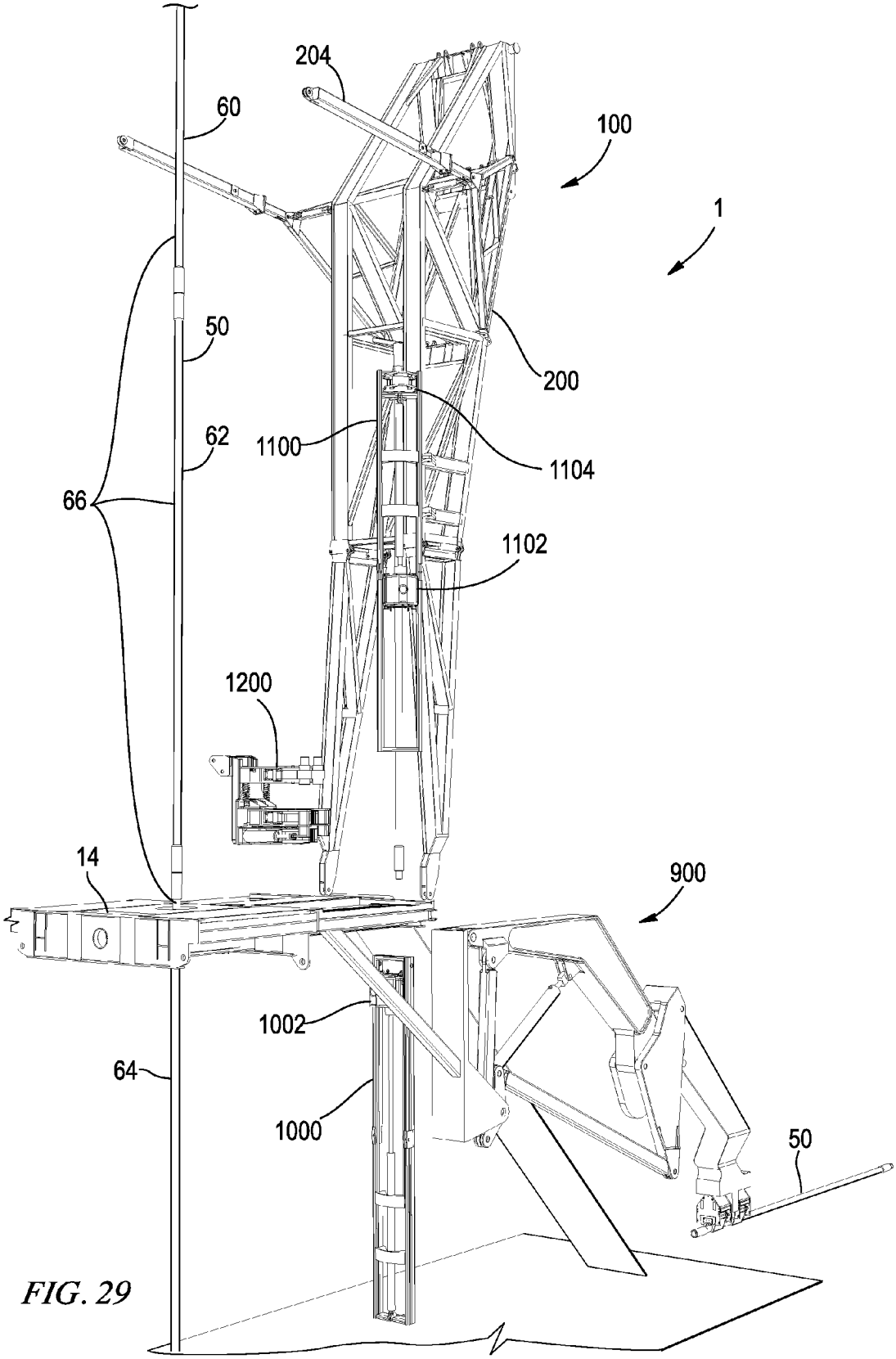
FIG. 29 is an isometric view of a drilling rig floor fitted with a tubular stand building system having features in accordance with the present invention, and generally illustrated from a side opposite that of FIG. 28, and illustrating only the base frame and braces of the pipe racking mechanism.

FIG. 29 is an isometric view of the automatic stand building system 1 shown in FIG. 28, as it appears from the opposite side. In this view, the lower elevator 1000 may be more clearly seen as located underneath the drill floor 14. Furthermore, the overall positional relationship between the horizontal to vertical mechanism 900, the lower elevator 1000, the upper elevator 1100, and the racking mechanism 100 are more clearly illustrated in FIG. 29.

Figure 30:
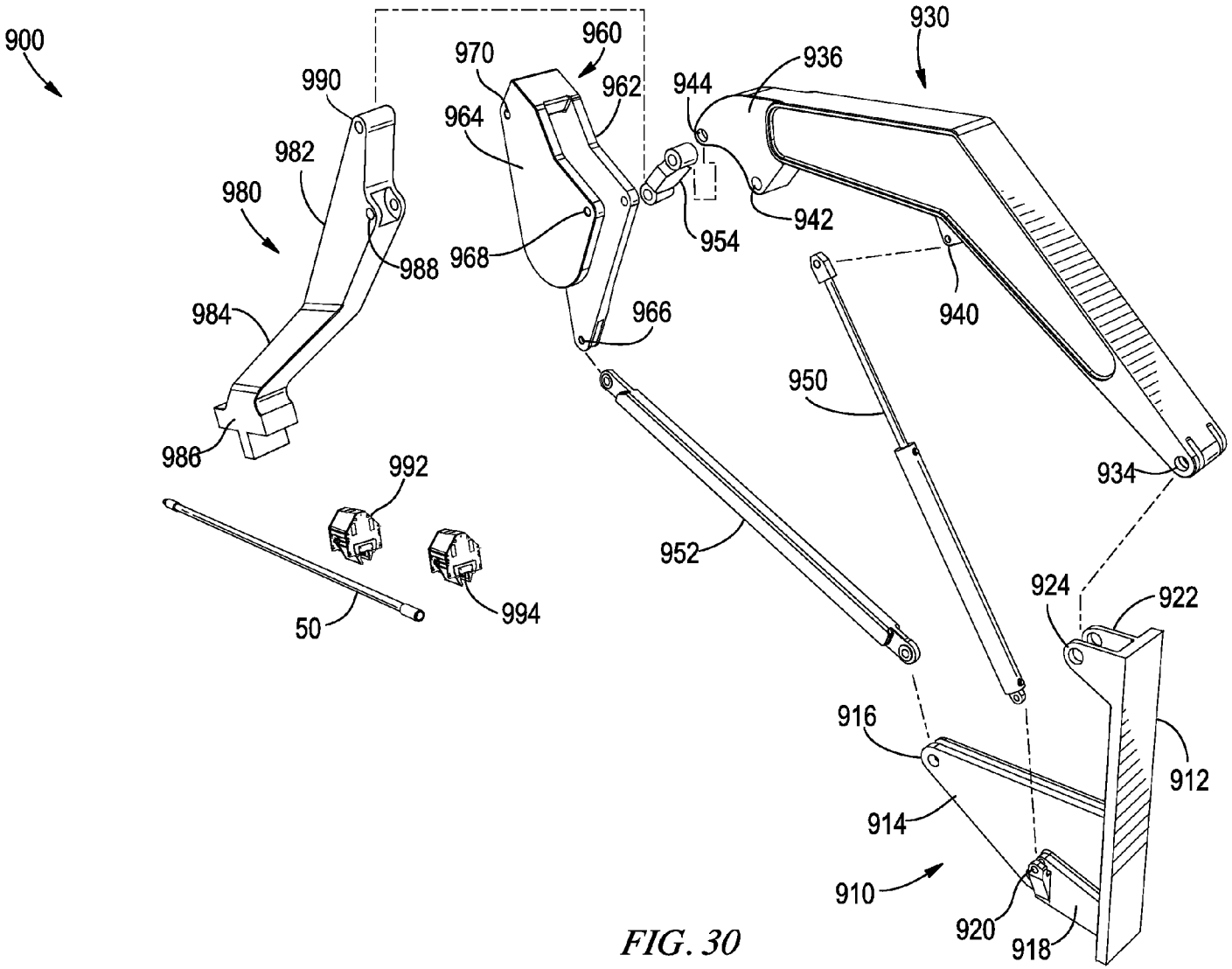
FIG. 30 is an isometric exploded view of the horizontal to vertical pipe feeding mechanism of the present invention used to bring a tubular such as a drill pipe section from beneath the drill rig floor for delivery to a lower elevator attached near the edge of the V-door side of the drill rig floor.

FIG. 30 is an isometric exploded view of the horizontal to vertical pipe feeding mechanism 900 of the present invention, used to bring tubulars such as drill pipe 50 from beneath drill rig floor 14 for delivery to lower elevator 1000 attached at the edge of the V-door side drill rig floor 14. In the view provided by FIG. 30, the various components which make up the horizontal to vertical mechanism 900 are illustrated in detail, and are further described below.

Horizontal to vertical mechanism 900 has a base 910. In the embodiment shown, base 910 has a flange 912 for connection to drill rig 10. Base 910 is pivotally connected to a boom 930, a cylinder 950 and a link 952. In one embodiment, base 910 has a boom flange 922 with a boom pivot 924. Base 910 has a link flange 914 with a link pivot 916. Link flange 914 extends outward from flange 912 further than boom flange 924. Base 910 has a cylinder flange 918 with a cylinder pivot 920.

Horizontal to vertical mechanism 900 has an angular boom 930. In the embodiment shown, boom 930 has a base connect end 934 for pivotal connection to base 910 at boom pivot 924. Boom 930 has a yoke 936 on its opposite end. Yoke 936 has a brace pivot 944 and an arm pivot 942. In the embodiment illustrated, boom 930 is pivotally connectable to cylinder 950 at a cylinder pivot 940.

Horizontal to vertical mechanism 900 has a lever 960. Lever 960 is pivotally connected to boom 930, link 952, and arm 980. In the embodiment shown, lever 960 has an outer lobe 962 and an inner lobe 964. In this embodiment, inner lobe 964 is shorter than outer lobe 962. Outer lobe 962 has a pivot connection 966 for pivotal connection to link 952. A pivot connection 968 is provided between outer lobe 962 and inner lobe 964 for pivotal connection to boom 930 at pivot connection 942. A pivot connection 970 is provided between outer lobe 962 and inner lobe 964 for pivotal connection to arm 980 at pivot connection 988.

Horizontal to vertical mechanism 900 has a brace 954. Brace 954 is pivotally connected between boom 930 and arm 980. In the embodiment shown, brace 954 is pivotally connected at one end to pivot point 944 on yoke 936 of boom 930. Brace 954 is pivotally connected at its opposite end to pivot 990 of arm 980.

Horizontal to vertical mechanism 900 has an arm 980. Arm 980 is pivotally connected to lever 960 and to boom 930 through brace 954. In the embodiment shown, arm 980 is pivotally connected to lever 960 between inner lobe 964 and outer lobe 962 at pivot point 968. Arm 980 is pivotally connected to brace 954 at pivot 990.

Arm 980 has an upper arm portion 982 and a lower arm portion 984. Lower arm 984 is angularly disposed to upper arm 982 in a direction that extends beneath inner lobe 964 of lever 960. Arm 980 has a gripper head 986 on the free end of lower arm 984. Gripper head 986 has attached at least one gripper 992 capable of clamping onto the exterior of a drilling tubular such as a section of drill pipe 50 and of supporting the load of the tubular 50. In the embodiment shown, a second gripper 994 is provided for increased lifting and support capability. In another embodiment, not shown, grippers 992 and 994 are controllably and rotatably attached to arm 980, for additional positioning control of drill pipe 50.

Cylinder 950 is pivotally connected between base 910 and boom 930. Cylinder 950 is pivotally connected at one end to base 910 at cylinder pivot 920 on cylinder flange 918. Cylinder 950 is pivotally connected at its opposite end to boom 930 at cylinder pivot 940.

Link 952 is pivotally connected between base 910 and lever 960. Link 952 is pivotally connected at one end to base 910 at link pivot 916 on link flange 914. Link 952 is pivotally connected at its opposite end to lever 960 at pivot point 966 on outer lobe 962.

Figure 35:
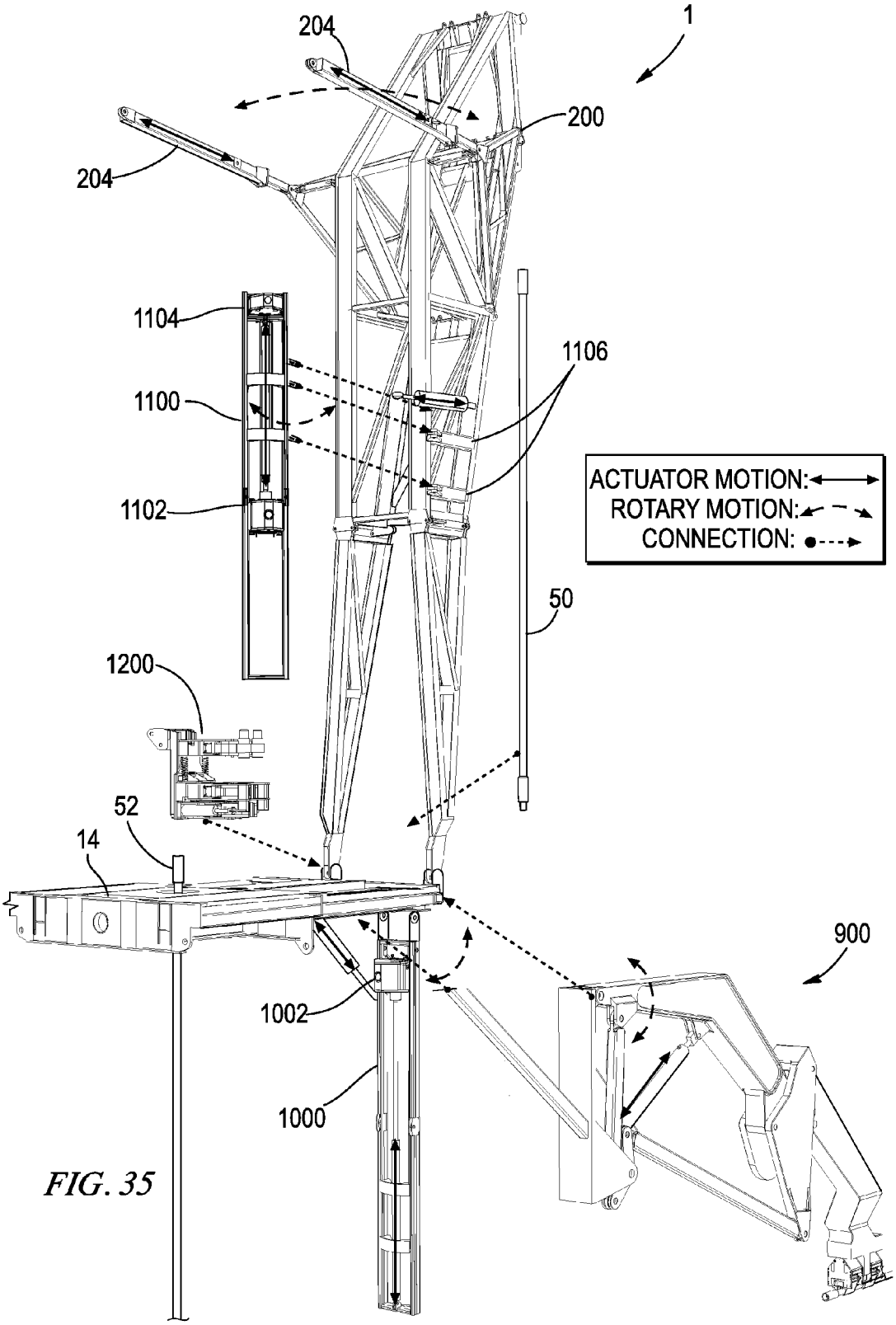
FIG. 35 is an isometric view of the tubular stand building system, illustrating the collective actuator control movements of the system during operation.

Although the above description discloses horizontal to vertical mechanism 900 as a six-bar mechanism, it has been recognized that an eight-bar mechanism may also be developed for this purpose by taking advantage of the unique geometry and kinematic relationships disclosed for horizontal to vertical mechanism 900. This may be preferred depending upon other variables such as the height of the drilling floor 14 of a particular drilling rig 10, or the total length of the stand of drill pipe 50 being utilized. In particular, such mechanism could include an additional linkage between base 910 and boom 930. An example of this mechanism is illustrated in FIG. 35 for comparison.

Figure 31:
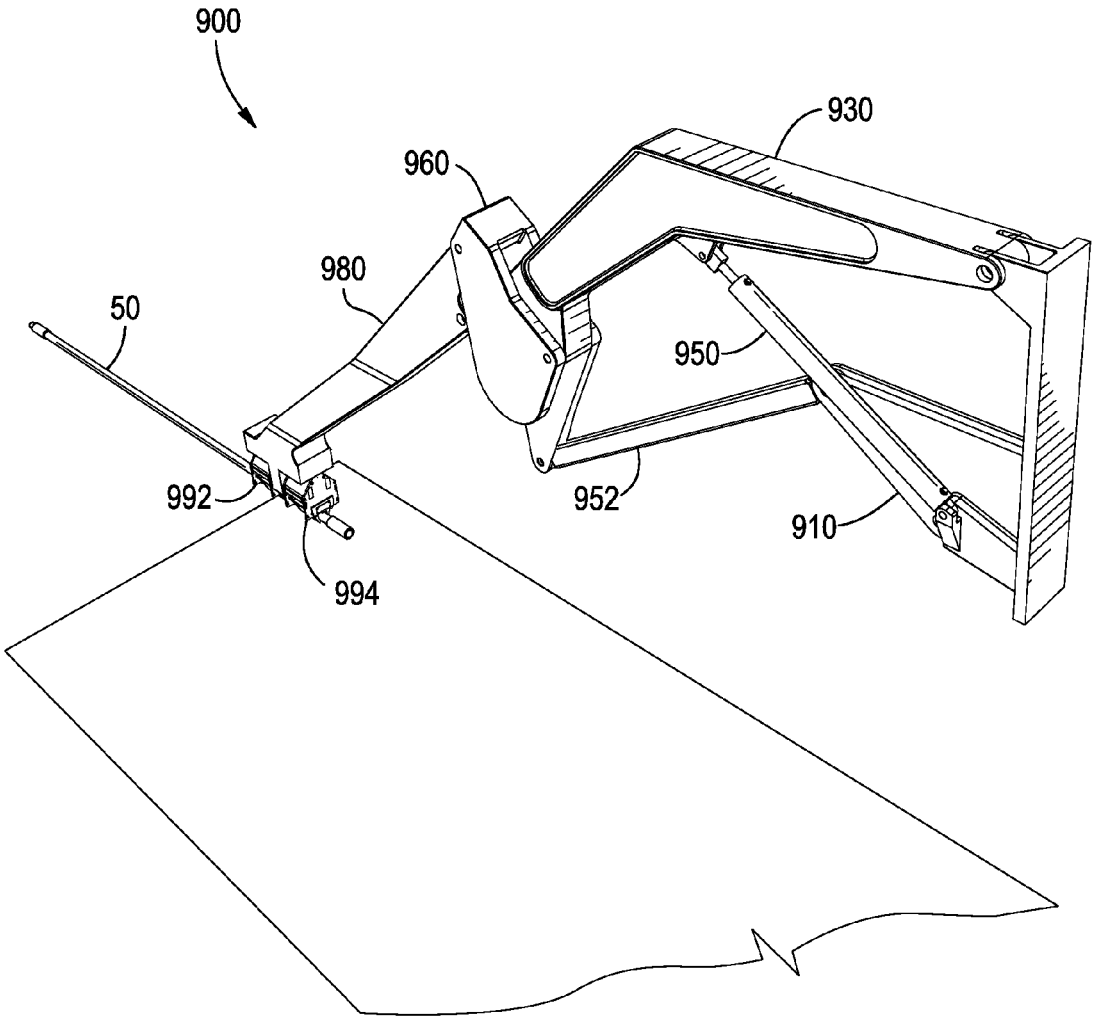
FIG. 31 is an isometric view of the horizontal to vertical pipe feeding mechanism, illustrating the mechanism at the bottom of its motion, having gripped a pipe section from a horizontal rack on the ground.

FIG. 31 is an isometric view of the horizontal to vertical pipe feeding mechanism 900, illustrating mechanism 900 at the bottom of its motion, having gripped a section of drill pipe 50 from a horizontal rack near the ground.

Figure 32:
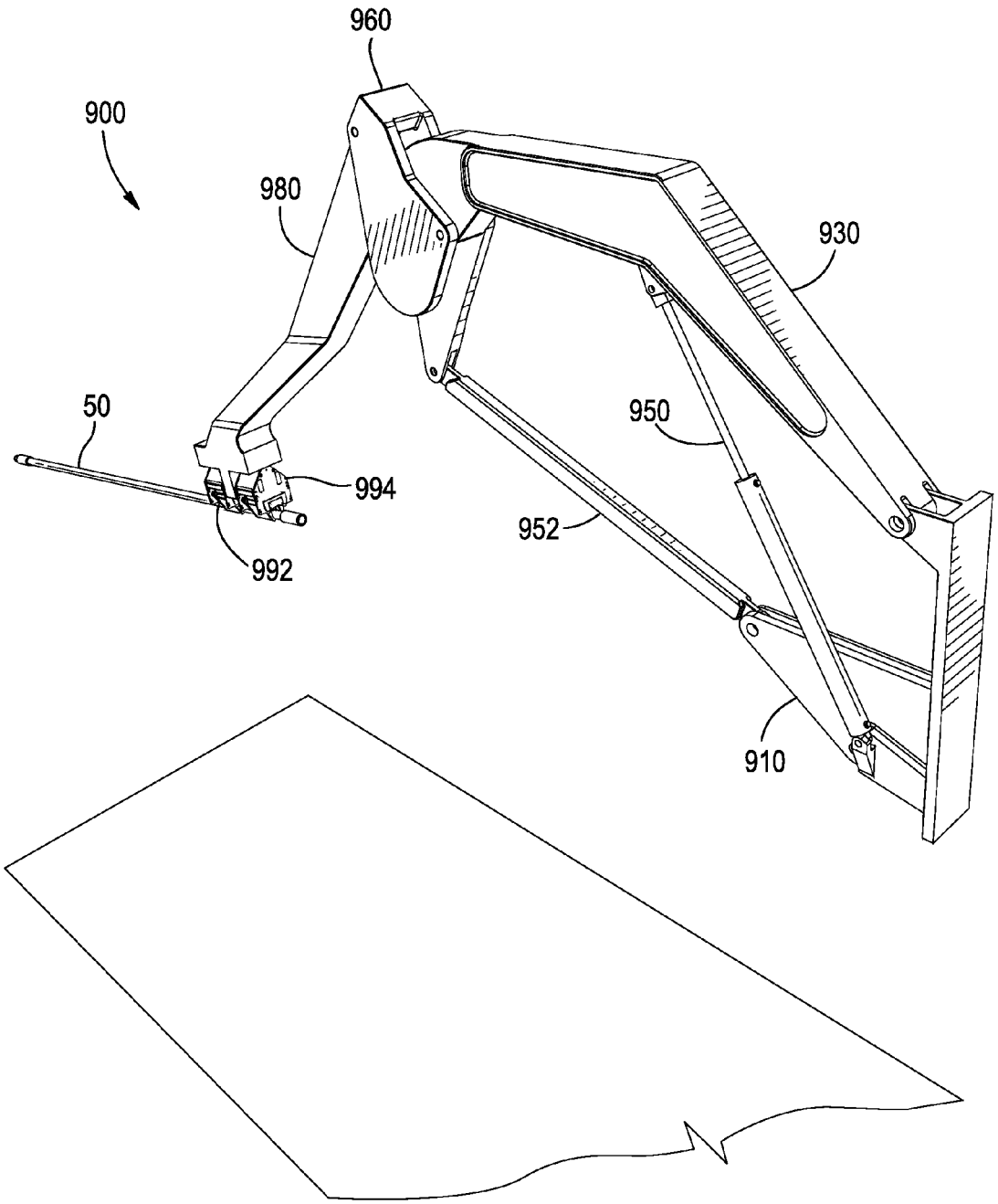
FIG. 32 is an isometric view of the horizontal to vertical pipe feeding mechanism, illustrating the mechanism moving upwards from its bottom position upon extension of the boom cylinder, and illustrating the upward movement of the pipe being retained in a generally horizontal position.

FIG. 32 is an isometric view of the horizontal to vertical pipe feeding mechanism 900, illustrating mechanism 900 moving upwards from its bottom position upon extension of cylinder 950, and illustrating the upward movement of drill pipe 50, being advantageously retained in a generally horizontal position at this stage of the movement, thus clearing an optional V-door ramp, and accommodating variable heights of conventional drill floors 14.

Figure 33:
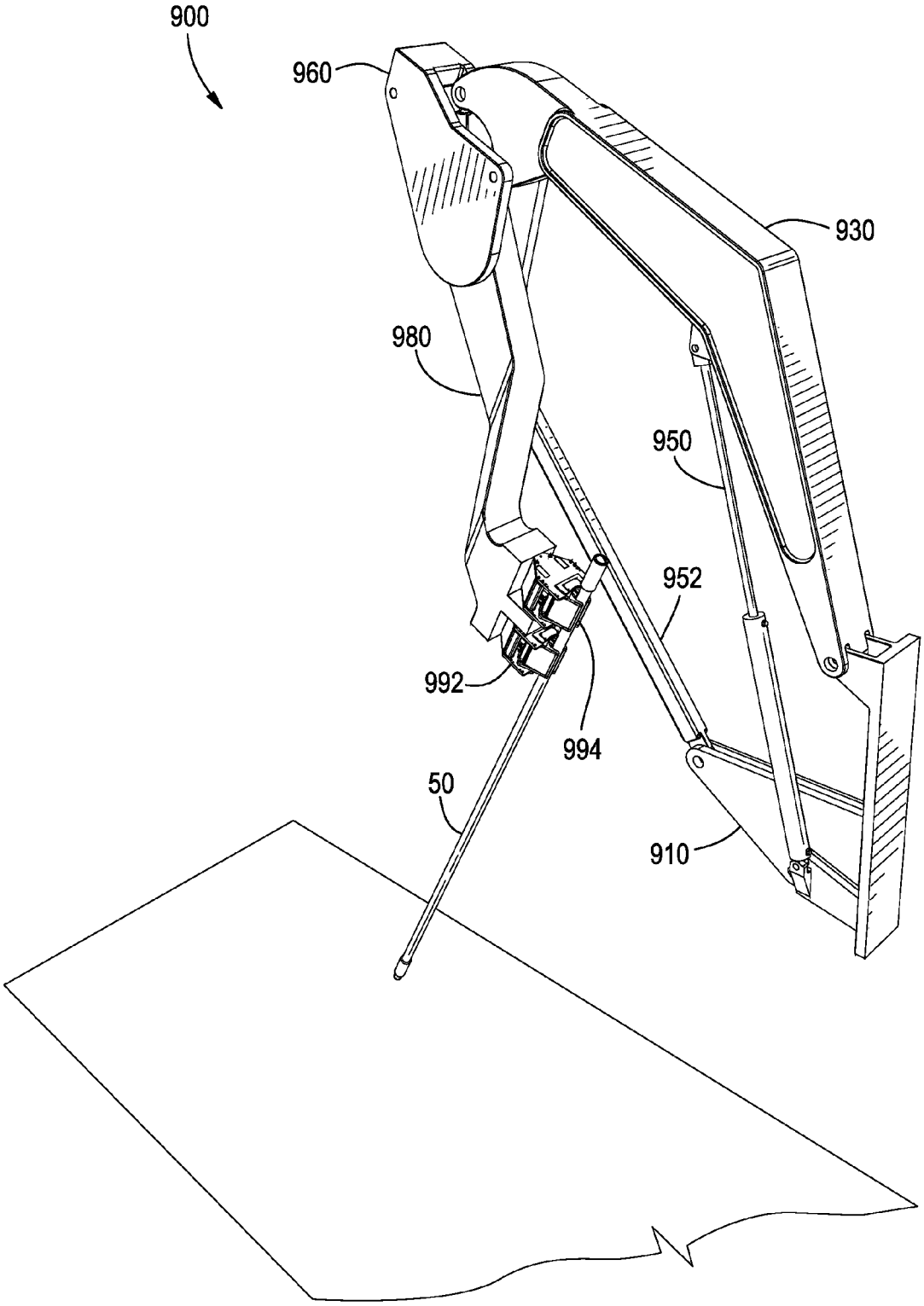
FIG. 33 is an isometric view of the horizontal to vertical pipe feeding mechanism, illustrating the continued upward movement of the mechanism, and the translation of the pipe from a horizontal position to a vertically inclined position.

FIG. 33 is an isometric view of the horizontal to vertical mechanism 900, illustrating the mechanism's continued upward movement, and the translation of drill pipe 50 from a horizontal position to a vertically inclined position.

Figure 34:
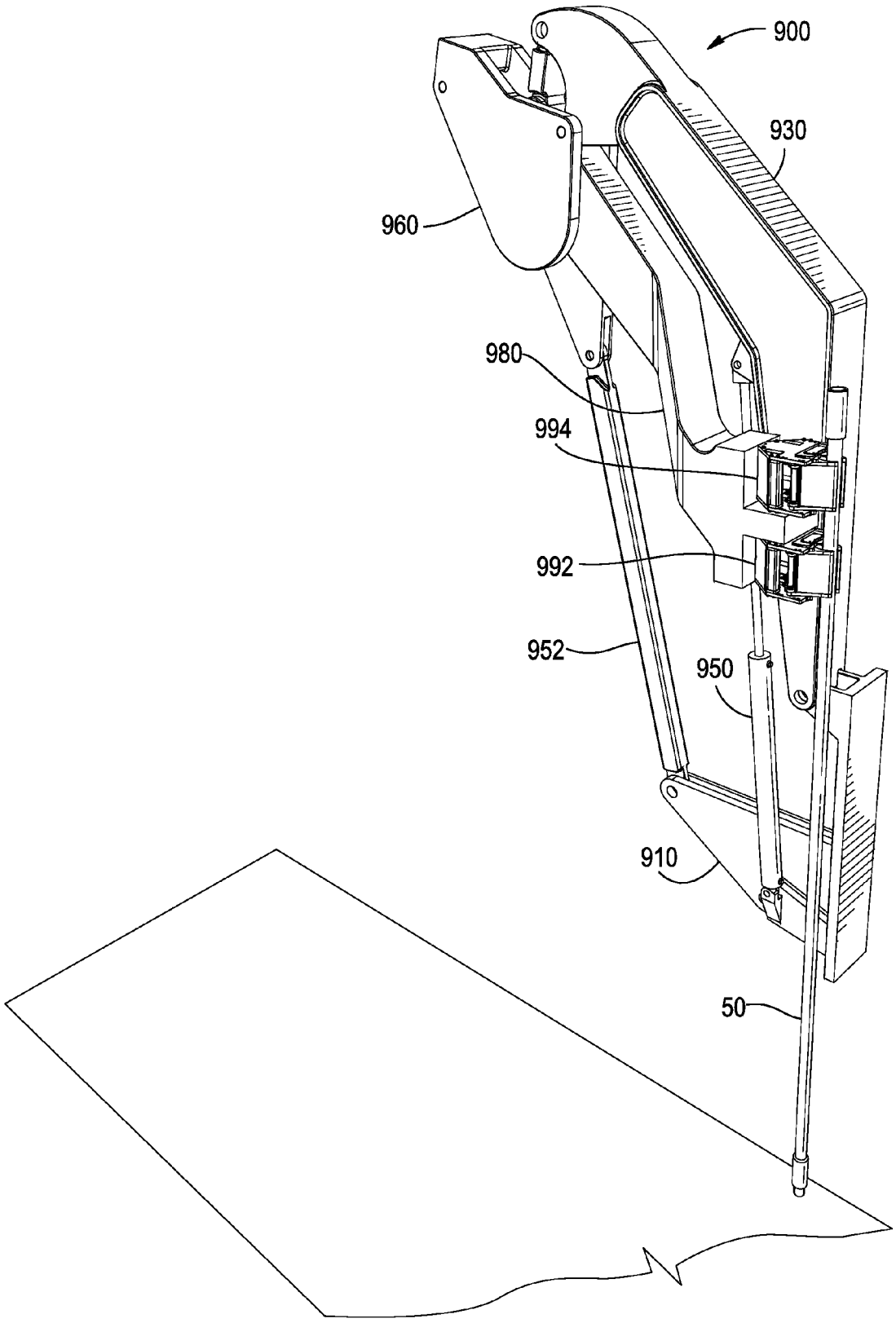
FIG. 34 is an isometric view of the horizontal to vertical pipe feeding mechanism, illustrating the mechanism in its fully raised position, and with the pipe being fully vertical.

FIG. 34 is an isometric view of the horizontal to vertical mechanism 900, illustrating mechanism 900 in its fully raised position, and with drill pipe 50 being fully vertical for gripping by gripper 1002 of lower elevator 1000 (see FIG. 35).

FIG. 35 is an isometric view of the tubular stand building system 1, illustrating the collective actuator control movements of tubular stand building system 1 in operation, as is described further below. In FIG. 35, the internal components of the racking mechanism 100 are excluded for visibility of the remaining components of tubular stand building mechanism 1, illustrating only base frame 200 of racking mechanism 100. In this view it is seen that upper elevator 1100 can be pivotally attached to base frame 200 with hinge-type or other pivots 1106. It can also be seen that extendable mast braces 204 can be used to alter the verticality of base frame 200 with respect to mast 16 (not shown) via extension or retraction of the mast braces 204.

Operation of the Invention

Referring to FIG. 35, lower elevator 1000 is mounted to drilling rig 10 for receiving a section of drill pipe 50 in a vertical orientation from horizontal to vertical mechanism 900. Lower elevator 1000 may be pivotally attached to drilling rig 10 so that it may be attached in a horizontal position prior to raising the substructure. Lower elevator 1000 has at least one gripper 1002 that is vertically translatable along the length of lower elevator 1000. Gripper 1002 is capable of clamping onto the exterior of drilling tubular 50 and supporting the load of tubular 50.

Referring back to FIGS. 28-29, racking mechanism 100 is provided, having base frame 200 connectable to a drill floor 14 of a drill rig 10 and extending upwards at a position offset to a V-door side 18 of a drilling mast 16 that is also connected to drill floor 14. In one embodiment, the base frame 200 is a C-frame design. A mast brace 204 is connected between base frame 200 and drilling mast 16 at a position distal to drill floor 14 for stabilizing an upper end of base frame 200 in relationship to mast 16. In one embodiment, mast brace 204 is adjustable for tilting racking mechanism 100 slightly towards mast 16. A tensioning member 206 may be connected between base frame 200 and drilling floor 14 for stabilizing base frame 200 in relationship to the substructure.

The racking mechanism 100 is capable of moving stands of pipe between a racked position within the racking board 20 and the over-well position such as well centerline 70.

In one embodiment, a lateral extend mechanism 300 is pivotally connectable to base frame 200. Lateral extend mechanism 300 is extendable between a retracted position and a deployed position. A rotate mechanism 500 is connected to lateral extend mechanism 300 and is rotatable in each of a left and right direction. A finger extend mechanism 700 is connected to rotate mechanism 500. Finger extend mechanism 700 is laterally extendable between a retracted position and a deployed position.

A grip and stab mechanism 800 is attached to finger extend mechanism 700. Grip and stab mechanism 800 has grippers 820, 830, 840 to hold a drill pipe 50 or stand of pipe and is capable of moving the pipe 50 vertically to facilitate stabbing. Lateral extend mechanism 300 is deployable to move finger extend mechanism 700 and grip and stab mechanism 800 between a position beneath a racking board 20 cantilevered from mast 16 to a position substantially beneath mast 16, and back.

In another embodiment, movement of lateral extend mechanism 300 between the retracted position and the deployed position moves rotate mechanism 500 along a substantially linear path. In a more preferred embodiment, movement of lateral extend mechanism 300 between the retracted position and the deployed position moves the rotate mechanism along a substantially horizontal path.

Rotate mechanism 500 is rotatable in each of a left and right direction. In a more preferred embodiment, the rotate mechanism is rotatable in each of a left and right direction by at least 90 (ninety) degrees. In a preferred embodiment, grip and stab mechanism 800 is vertically translatable to vertically raise and lower the load of a stand of pipe 50.

In another embodiment, racking mechanism 100 may be series nesting. In this embodiment, finger extend mechanism 700 and grip and stab mechanism 800 are substantially retractable into rotate mechanism 500, which is substantially retractable into pivot frame 400 of lateral extend mechanism 300, which is substantially retractable into base frame 200.

An upper elevator 1100 is pivotally connected to base frame 200 for receiving a drill pipe 50 in a vertical orientation from a lower elevator 1000. Upper elevator 1100 has a lower gripper 1102 and an upper gripper 1104. Upper gripper 1104 is vertically translatable along the length of upper elevator 1100. Upper gripper 1104 and lower gripper 1102 are both capable of clamping onto the exterior of a drill pipe 50 and supporting the load of the drill pipe.

A stand building power tong 1200 is provided for rotating drill pipe 50 to be connected between upper elevator 1100 and the lower elevator 1000.

Remaining on FIGS. 28-29, in operation, the horizontal to vertical machine 900 grips a first tubular 60, such as a section of drill pipe 50, and raises it from a horizontal position near the ground to a vertical position proximate to drill floor 14 and adjacent to lower elevator 1000. Lower elevator 1000 receives the first tubular 60 from the horizontal to vertical machine 900. Lower elevator 1000 raises the first tubular 60 vertically, wherein upper elevator 1100 grips and continues to vertically raise the first tubular 60.

The horizontal to vertical machine 900 grips a second tubular 62 and raises it from a horizontal position near the ground to a vertical position proximate to drill floor 14 and adjacent the lower elevator 1000. Lower elevator 1000 receives second tubular 62 from the horizontal to vertical machine 900 and raises the second tubular 62 vertically until the female connection of second tubular 62 engages the male connection of first tubular 60. Stand building power tong 1200 rotates one of the tubulars in relation to the other to make-up the threaded connection between them. Upper elevator 1100 then grips and vertically raises the connected first tubular 60 and second tubular 62.

Depending on the needs of a well operator and the requirements on the length of a pipe stand, horizontal to vertical machine 900 may grip a third tubular 64 and raise it from a horizontal position near the ground to a vertical position proximate to drill floor 14 and adjacent to the lower elevator 1000. Lower elevator 1000 receives the third tubular 64 from the horizontal to vertical machine 900 and raises the third tubular 64 vertically until the female connection of third tubular 64 engages the male connection of the second tubular 62. Stand building power tong 1200 then rotates one of the tubulars in relation to the other to make-up the threaded connection between them. Upper elevator 1100 then grips and vertically raises the connected first, second and third tubulars 60, 62, 64, which collectively make up a connected pipe stand 66.

The racking mechanism 100 receives the connected pipe stand 66 from upper elevator 1100, whereupon, the upper elevator 1100 releases the connected pipe stand 66. In one embodiment, upper elevator 1100 may then be rotated with respect to base frame 200 of racking mechanism 100 such that upper elevator 1100 is no longer in the way.

In another embodiment, racking mechanism 100 then tilts the connected pipe stand 66 inside racking board 20. Racking mechanism 100 may be tilted by actuating linearly adjustable mast braces 204 connected to drilling mast 16. (See FIG. 35). The racking mechanism 100 is then used to locate connected pipe stand 66 in racking boards 20, and to move pipe stand 66 between racking board 20 and the wellbore 12.

The references and relationship between first, second and third tubulars 60, 62, 64 are illustrated in FIG. 28, which shows first, second and third tubulars 60, 62, 64 threaded together as connected pipe stand 66, and positioned over stump 52 by racking mechanism 100.

As will be understood by one of ordinary skill in the art, the sequence of the steps disclosed may be modified and the same advantageous result obtained. For example, the wings may be deployed before connecting the lower mast section to the drill floor (or drill floor framework).

As described, the relationship of these elements has been shown to be extremely advantageous in providing a racking mechanism 100 that can be mounted to a conventional drill floor, and that is capable of lifting and moving drill pipe between a racked position within a largely conventional racking board and a stabbed position over a wellbore.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is appropriate that the appended claims be construed broadly and in a manner consistent with the scope of the invention.

The invention claimed is:

1. A pipe stand builder, comprising:

a drilling rig having a drill floor;

a horizontal to vertical mechanism attached to a side of the drill floor;

a lower elevator located below a side of the drill floor for receiving a section of tubular from the horizontal to vertical mechanism;

an upper elevator located above the drill floor for receiving the section of tubular from the lower elevator;

a power tong for threaded connection by relative rotation between two sections of the tubular in the lower elevator and the upper elevator;

a base frame connectable to the drill floor of the drilling rig;

the upper elevator connected to the base frame;

a lateral extend mechanism having a mast side and an opposite base connect side, the base connect side being pivotally connected to the base frame;

a pivot frame pivotally connected to the mast side of the lateral extend mechanism;

a rotate mechanism connected to the pivot frame;

a rotate frame pivotally connected to the rotate mechanism;

a finger extend mechanism having a mast side and an opposite frame side, the frame side pivotally attached to the rotate frame; and, a grip and stab mechanism pivotally connected to the mast side of the finger extend mechanism.

2. A pipe stand builder, comprising:

a drilling rig having a drill floor;

a horizontal to vertical mechanism attached to a side of the drill floor, the horizontal to vertical mechanism comprising:

a base;

a boom having a first end pivotally connected to the base and a second end;

the boom having an angular boom;

a lever pivotally connected to the second end of the boom;

the lever having an inner lobe and an outer lobe, the inner lobe being shorter in relation to the outer lobe;

an arm having a first end pivotally connected to the lever, the arm comprising:

an upper arm and a lower arm; and, the lower arm angularly disposed in relation to the upper arm;

a gripper attached to a second end of the arm;

a cylinder having a first end pivotally connected to the base, the cylinder having a second end pivotally connected to a portion of the boom between the first and second ends of the boom;

a link flange extending outwardly from the base;

a link pivotally connected between the link flange and the outer lobe of the lever; and, a brace having a first end pivotally connected to the second end of the boom, the brace having a second end pivotally connected to the first end of the arm;

a lower elevator located below a side of the drill floor for receiving a section of tubular from the horizontal to vertical mechanism;

an upper elevator located above the drill floor for receiving the section of tubular from the lower elevator; and, a power tong for threaded connection by relative rotation between two sections of the tubular in the lower elevator and the upper elevator.

* * * * *